US012503207B1

(12) United States Patent
Tate et al.

(10) Patent No.: US 12,503,207 B1
(45) Date of Patent: Dec. 23, 2025

(54) MARINE PROPULSION CONTROL SYSTEM AND METHOD WITH PROXIMITY-BASED VELOCITY LIMITING

(71) Applicant: Brunswick Corporation, Mettawa, IL (US)

(72) Inventors: Brandon L. Tate, Walnut Hill, IL (US); Stephen P. Landers, South Lebanon, OH (US)

(73) Assignee: Brunswick Corporation, Mettawa, IL (US)

( * ) Notice: Subject to any disclaimer, the term of this patent is extended or adjusted under 35 U.S.C. 154(b) by 160 days.

(21) Appl. No.: 18/468,052

(22) Filed: Sep. 15, 2023

(51) Int. Cl.
*B63B 79/40* (2020.01)
*B63B 79/10* (2020.01)
*B63H 21/21* (2006.01)

(52) U.S. Cl.
CPC ..... *B63B 79/40* (2020.01); *B63B 79/10* (2020.01); *B63H 21/21* (2013.01); *B63H 2021/216* (2013.01)

(58) Field of Classification Search
CPC ..... B63B 79/40; B63B 79/10; B63H 21/21; B63H 2021/216
USPC ..... 701/21
See application file for complete search history.

(56) References Cited

U.S. PATENT DOCUMENTS 6,273,771 B1 8/2001 Buckley et al.
9,927,520 B1 3/2018 Ward et al.
10,259,555 B2 * 4/2019 Ward ..... B63H 21/213
10,322,787 B2 * 6/2019 Ward ..... B63H 25/04
10,429,845 B2 10/2019 Arbuckle et al.
10,431,099 B2 10/2019 Stewart et al.
11,022,442 B1 6/2021 Paskaris et al.
11,373,537 B2 6/2022 Derginer et al.
11,403,955 B2 * 8/2022 Derginer ..... G05D 1/0206
11,436,927 B2 9/2022 Derginer et al.
11,473,914 B2 10/2022 Yamabayashi et al.
11,733,699 B2 * 8/2023 Johnson ..... G01S 7/003 701/21
2020/0132467 A1 4/2020 Borovac et al.
2020/0247518 A1 * 8/2020 Dannenberg ..... B63H 21/21
2020/0250992 A1 * 8/2020 Derginer ..... B63H 25/04
2022/0371704 A1 * 11/2022 Gatland ..... B63H 25/04

* cited by examiner

*Primary Examiner* — Yazan A Soofi
(74) *Attorney, Agent, or Firm* — Andrus Intellectual Property Law, LLP

(57) ABSTRACT

A propulsion control system on a marine vessel is provided, the propulsion control system comprising: a propulsion device configured to propel the marine vessel; proximity sensors configured to generate proximity measurements indicative of a proximity of an object with respect to the marine vessel; a processor configured to: receive proximity information based on proximity measurements generated by the proximity sensors; analyze the proximity information within a predetermined area around the marine vessel; determine that objects that are not in a planned path of the marine vessel are located in the predetermined area; set a velocity limit along the planned path of the marine vessel based on the presence of the objects within the predetermined area; and control the propulsion device such that a velocity of the marine vessel along the planned path does not exceed the velocity limit.

25 Claims, 10 Drawing Sheets

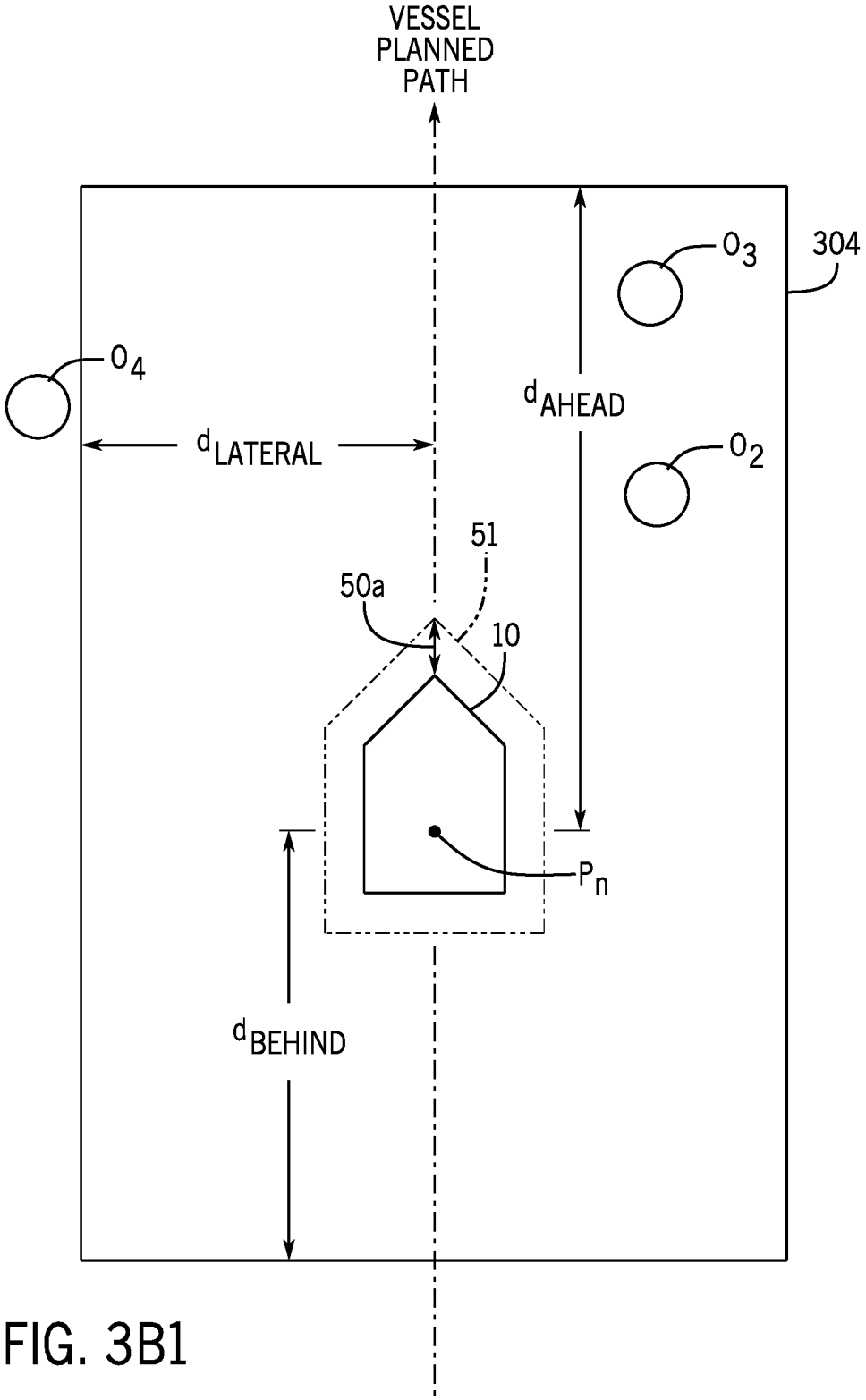
FIG. 3B1

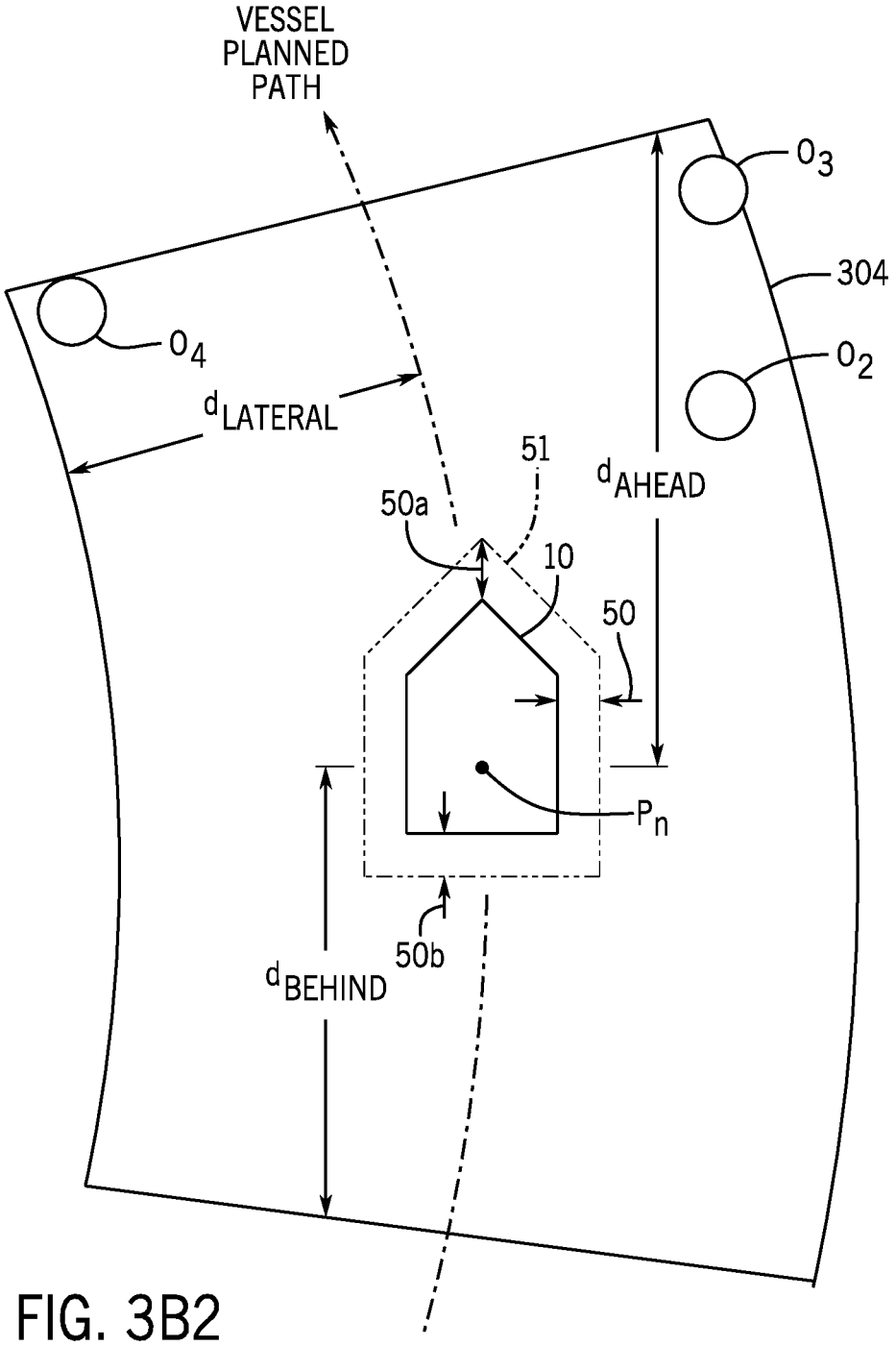
FIG. 3B2

MARINE PROPULSION CONTROL SYSTEM AND METHOD WITH PROXIMITY-BASED VELOCITY LIMITING

FIELD

The present disclosure generally relates to propulsion control systems and methods for controlling propulsion of a marine vessel, and more specifically to propulsion control systems and methods that limit velocity of the marine vessel based on proximity of objects near the marine vessel.

BACKGROUND

The following U.S. Patents are incorporated herein by reference, in entirety:

U.S. Pat. No. 9,927,520 discloses a method of detecting a collision of the marine vessel, including sensing using distance sensors to determine whether an object is within a predefined distance of a marine vessel, and determining a direction of the object with respect to the marine vessel. The method further includes receiving a propulsion control input at a propulsion control input device, and determining whether execution of the propulsion control input will result in any portion of the marine vessel moving toward the object. A collision warning is then generated.

U.S. Pat. No. 10,322,787 discloses a system for maintaining a marine vessel in a body of water at a selected position and orientation, including a global positioning system that determines a global position and heading of the vessel and a proximity sensor that determines a relative position and bearing of the vessel with respect to an object near the vessel. A controller operable in a station-keeping mode is in signal communication with the GPS and the proximity sensor. The controller chooses between using global position and heading data from the GPS and relative position and bearing data from the proximity sensor to determine if the vessel has moved from the selected position and orientation. The controller calculates thrust commands required to return the vessel to the selected position and orientation and outputs the thrust commands to a marine propulsion system, which uses the thrust commands to reposition the vessel.

U.S. Pat. No. 10,259,555 discloses a method for controlling movement of a marine vessel near an object, including accepting a signal representing a desired movement of the marine vessel from a joystick. A sensor senses a shortest distance between the object and the marine vessel and a direction of the object with respect to the marine vessel. A controller compares the desired movement of the marine vessel with the shortest distance and the direction. Based on the comparison, the controller selects whether to command the marine propulsion system to generate thrust to achieve the desired movement, or alternatively whether to command the marine propulsion system to generate thrust to achieve a modified movement that ensures the marine vessel maintains at least a predetermined range from the object. The marine propulsion system then generates thrust to achieve the desired movement or the modified movement, as commanded.

U.S. Pat. No. 10,429,845 discloses a marine vessel powered by a marine propulsion system and movable with respect to first, second, and third axes that are perpendicular to one another and define at least six degrees of freedom of potential vessel movement. A method for controlling a position of the marine vessel near a target location includes measuring a present location of the marine vessel, and based on the vessel's present location, determining if the marine vessel is within a predetermined range of the target location. The method includes determining marine vessel movements that are required to translate the marine vessel from the present location to the target location. In response to the marine vessel being within the predetermined range of the target location, the method includes automatically controlling the propulsion system to produce components of the required marine vessel movements one degree of freedom at a time during a given iteration of control.

U.S. Pat. No. 11,373,537 discloses a propulsion control system on a marine vessel that includes at least one propulsion device configured to propel the marine vessel, at least one input device manipulatable to provide user control input to control a movement direction and velocity of the marine vessel, at least one proximity sensor system configured to generate proximity measurements describing a proximity of an object with respect to the marine vessel, and a controller. The controller is configured to limit user input authority over propulsion output in a direction of the object by at least one propulsion device based on the proximity measurement so as to maintain the marine vessel at least a buffer distance from the object, and then to suspend the maintenance of the buffer distance from the object upon receipt of a user-generated instruction to do so. Upon receipt of a user control input via the user input device to move the marine vessel in the direction of the object, the controller controls the at least one propulsion device based on the user control input such that the marine vessel approaches and impacts the object.

U.S. Pat. No. 11,403,955 discloses a propulsion control system on a marine vessel that includes at least one propulsion device configured to propel the marine vessel and at least one proximity sensor system configured to generate proximity measurements describing a proximity of an object with respect to the marine vessel. The system further includes a controller configured to receive proximity measurements, access a preset buffer distance, and calculate a velocity limit in a direction of the object for the marine vessel based on the proximity measurements and the preset buffer distance so as to progressively decrease the velocity limit as the marine vessel approaches the preset buffer distance from the object.

U.S. Pat. No. 11,436,927 discloses a system for proximity sensing on a marine vessel that includes a main inertial measurement unit (IMU) positioned at a main installation attitude and a main location, a first proximity sensor configured to measure proximity of objects from a first sensor location, and a first sensor IMU positioned at the first sensor location and at a first installation attitude. A sensor processor is configured to receive main IMU data from the main IMU and first IMU data from the first sensor IMU, and then determine a relative orientation transform between the main installation attitude and the first installation attitude by comparing the main IMU data and the first IMU data, and then determine a relative position transform between the main location and the first sensor location based on the relative orientation transform, the main IMU data, and the first IMU data.

SUMMARY

In accordance with some embodiments of the disclosed subject matter, a propulsion control system for on a marine vessel is provided, the propulsion control system comprising:

In accordance with some embodiments of the disclosed subject matter, a propulsion control system on a marine vessel is provided, the propulsion control system comprising: at least one propulsion device configured to propel the marine vessel; a plurality of proximity sensors configured to generate proximity measurements indicative of a proximity of an object with respect to the marine vessel; one or more hardware processors configured to: receive proximity information based on proximity measurements generated by the plurality of proximity sensors; analyze the proximity information within a predetermined area around the marine vessel; determine that one or more objects are located in the predetermined area around the marine vessel, wherein the one or more objects are not in a planned path of the marine vessel; set a velocity limit along the planned path of the marine vessel based at least in part on the presence of the one or more objects within the predetermined area; and control the at least one propulsion device such that a velocity of the marine vessel along the planned path does not exceed the velocity limit.

In some embodiments, the predetermined area around the marine vessel has a circular shape that extends in a radius $d_{radius}$.

In some embodiments, $d_{radius}$ is not greater than 25 meters.

In some embodiments, the predetermined area around the marine vessel extends in a forward direction along the planned path a distance $d_{ahead}$, and extends in a backward direction along the planned path a distance $d_{behind}$.

In some embodiments, $d_{ahead}>d_{behind}$.

In some embodiments, the proximity information comprises an occupancy grid comprising a plurality of cells, wherein a value associated with each cell is indicative of a probability that the cell is occupied by an obstruction.

In some embodiments, the occupancy grid is associated with a plurality of layers, each of the plurality of layers indicative of a probability that the cell is occupied by an obstruction that is an instance of a respective class of a plurality of classes.

In some embodiments, the one or more hardware processors are further configured to: set the velocity limit based on a probability that a cell of the occupancy grid within the predetermined area around the marine vessel is occupied by an obstruction that is an instance of a class within a set of classes of the plurality of classes.

In some embodiments, the set of classes includes: a class encompassing swimmers; and a class encompassing human-powered vessels.

In some embodiments, the set of classes excludes all classes that encompass non-mobile inanimate objects.

In some embodiments, the one or more hardware processors are further configured to: receive second proximity information based on second proximity measurements generated by the plurality of proximity sensors during a second period of time, wherein the proximity information is based on proximity measurements generated by the plurality of proximity sensors during a first period of time; analyze the second proximity information within the predetermined area around the marine vessel; determine that a second set of one or more objects are located in the predetermined area around the marine vessel, wherein the second set of one or more objects are not in a planned path of the marine vessel; determine that none of the objects in the second set of objects are an instance of a class within the set of classes of the plurality of classes; and set a second velocity limit along the planned path of the marine vessel based at least in part on the presence of the second set of one or more objects within the predetermined area, wherein the second velocity limit is higher than the velocity limit.

In some embodiments, the one or more hardware processors are further configured to: determine that a particular object of the one or more objects is located within a threshold distance of the marine vessel; and in response to determining that the particular object of the one or more objects is located within the threshold distance of the marine vessel, set a second velocity limit, wherein the second velocity limit is lower than the velocity limit.

In some embodiments, the velocity limit is no greater than 1 meter per second.

In some embodiments, the plurality of proximity sensors includes at least one stereoscopic camera.

In accordance with some embodiments of the disclosed subject matter, a method for controlling propulsion of a marine vessel is provided, the method comprising: receiving proximity information based on proximity measurements generated by a plurality of proximity sensors, wherein the plurality of proximity sensors are configured to generate proximity measurements indicative of a proximity of an object with respect to the marine vessel; analyzing the proximity information within a predetermined area around the marine vessel; determining that one or more objects are located in the predetermined area around the marine vessel, wherein the one or more objects are not in a planned path of the marine vessel; setting a velocity limit along the planned path of the marine vessel based at least in part on the presence of the one or more objects within the predetermined area; and controlling at least one propulsion device configured to propel the marine vessel such that a velocity of the marine vessel along the planned path does not exceed the velocity limit.

Various other features, objects, and advantages of the disclosed subject matter can be more fully appreciated with reference to the following description taken together with the drawings.

BRIEF DESCRIPTION OF THE DRAWINGS

The present disclosure is described with reference to the following drawings.

FIGS. 3B1 and 3B2 show an example of a rectangular local consideration zone that can be analyzed for objects along a planned path of a marine vessel in accordance with some embodiments of the disclosed subject matter.

DETAILED DESCRIPTION

Figure 1:
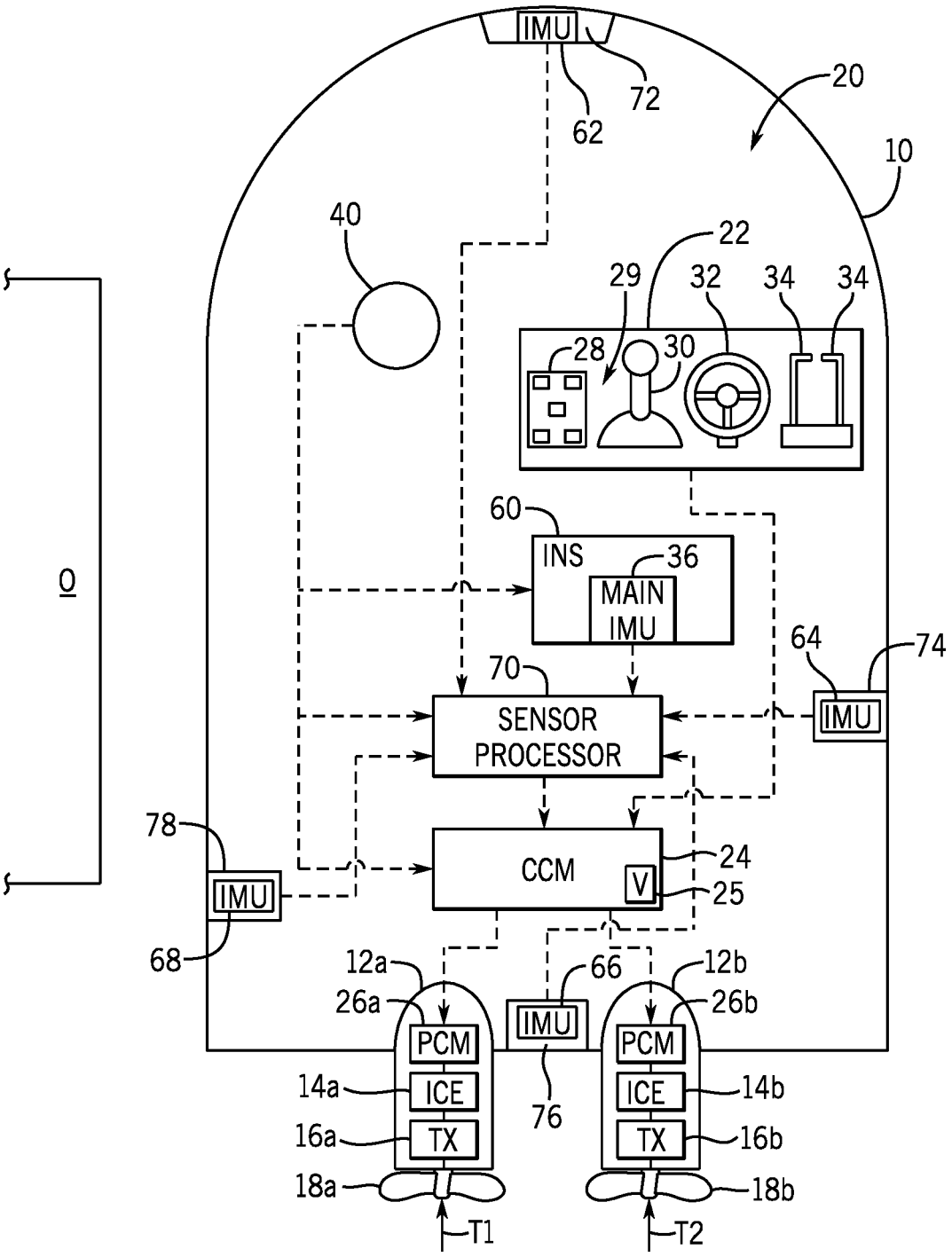
FIG. 1 shows an example of a schematic representation of a propulsion system on a marine vessel in accordance with some embodiments of the disclosed subject matter.

FIG. 1 shows an example of a schematic representation of a propulsion system on a marine vessel in accordance with some embodiments of the disclosed subject matter. FIG. 1 shows a marine vessel 10 equipped with a propulsion system 20 on marine vessel 10 configured in accordance with some embodiments of the disclosed subject matter. In some embodiments, propulsion system 20 can be configured to operate, for example, in a joysticking mode in which a joystick is operated by a user to control vessel movement within an x/y plane, among other modes (e.g., as described hereinbelow). In some embodiments, propulsion system 20 can include first and second propulsion devices 12*a*, 12*b* that produce first and second thrusts T1, T2 to propel the vessel 10. First and second propulsion devices 12*a*, 12*b* are illustrated as outboard motors, but can alternatively be inboard motors, stern drives, jet drives, pod drives, any other suitable propulsion device, or combinations thereof. Each propulsion device can be provided with an engine 14*a*, 14*b* operatively connected to a transmission 16*a*, 16*b*, in turn, operatively connected to a propeller 18*a*, 18*b*.

In some embodiments, vessel 10 can also house various control elements that comprise part of the marine propulsion system 20. For example, marine propulsion system 20 can comprise an operation console 22 in signal communication, for example via a controller area network (CAN) bus (e.g., as described in U.S. Pat. No. 6,273,771), with a controller 24, such as a command control module (CCM), and with propulsion control modules (PCM) 26*a*, 26*b* associated with the respective propulsion devices 12*a*, 12*b*. Each of controller 24 and the PCMs 26*a*, 26*b* can include memory and a programmable processor. Each control module 24, 26*a*, 26*b* can include one or more processors communicatively connected to a respective storage system comprising a computer-readable medium that includes volatile and/or nonvolatile memory upon which computer-readable code and data can be stored. Additionally or alternatively, in some embodiments, a processor(s) of one or more of control modules 24, 26*a*, 26*b* can be communicatively connected to a shared storage system comprising a computer-readable medium that includes volatile and/or nonvolatile memory upon which computer-readable code and data can be stored In some embodiments, each processor can access computer-readable code and, upon executing the code, carry out one or more functions, such as navigation control functions and/or proximity sensing calibration functions, as described in detail below.

In some embodiments, operation console 22 can include any suitable number of user input devices, such as, a keypad 28, a joystick 30, a steering wheel 32, and/or one or more throttle/shift levers 34. Each of these devices can be configured to input commands to controller 24, which can, in turn, communicate control instructions to first and second propulsion devices 12*a*, 12*b* by communicating with the PCMs 26*a*, 26*b*. In some embodiments, steering wheel 32 and throttle/shift lever(s) 34 can function in a conventional manner, such that rotation of steering wheel 32, for example, activates a transducer that provides a signal to controller 24 regarding a desired direction of the vessel 10. Controller 24 can, in turn, send signals to PCMs 26*a*, 26*b* (and/or thrust vector module(s) (TVMs), or additional modules if provided), which in turn can activate steering actuators to achieve desired orientations of the propulsion devices 12*a*, 12*b*. In some embodiments, propulsion devices 12*a*, 12*b* can be independently steerable about a respective steering axis. Throttle/shift lever(s) 34 can send signals to controller 24 regarding the desired gear (forward, reverse, or neutral) of transmissions 16*a*, 16*b* and desired rotational speed of engines 14*a*, 14*b* of propulsion devices 12*a*, 12*b*. Controller 24 can, in turn, send signals to PCMs 26*a*, 26*b*, which in turn activate electromechanical actuators in transmissions 16*a*, 16*b* and engines 14*a*, 14*b* for shift and throttle, respectively. A manually operable input device, such as joystick 30, can also be used to provide signals to controller 24. In some embodiments, joystick 30 can be used to allow an operator of vessel 10 to manually maneuver vessel 10, such as to achieve lateral translation or rotation of vessel 10.

In some embodiments, propulsion system 20 can also include one or more proximity sensors 72, 74, 76, and 78. In some embodiments, proximity sensors 72-78 can form a portion of a perception system associated with vessel 10 (note that a perception system is sometimes referred to as a vision system, and may be configured to use visible light sensing modes, as well as other sensing modes, such as sound-based sensing, radio-based sensing, infrared-based sensing, etc.). Although a limited number of proximity sensors are shown (e.g., one perpendicular to each of the bow, stern, and port and starboard sides the vessel 10), fewer or more sensors can be provided at each location and/or provided at other locations, such as on a hardtop of the vessel 10. In some embodiments, proximity sensors 72-78 can be used to determine a three-dimensional location of an object and/or other feature of an environment (e.g., a water surface) that is within a field of view of the proximity sensor with respect to the location of the proximity sensor (e.g., distance to various points on an object and a direction associated with each of the various points). For example, proximity sensors 72-78 can be implemented using one or more of depth cameras (e.g., implemented using stereoscopic imaging techniques, structured light imaging techniques, continuous-wave time-of-flight imaging techniques, direct time-of-flight imaging techniques, etc.), three-dimensional laser range finders (e.g., implemented using light detection and ranging (lidar) techniques), radars, sonars, and/or other devices individually capable of determining both the distance and direction to points on an object and/or other feature relatively accurately (e.g., on the order of centimeters at relatively close ranges, such as up to several meters, and on the order of a meter at relatively distant ranges, such as upward of 50 m, with accuracy decreasing with distance)), e.g., the relative position of various points on an object O (such as a dock, a seawall, a slip, another vessel, a person, a portion of a bridge, a portion of a dam, a relatively large rock, a tree, etc.) with respect to each sensor 72-78 having a field of view that includes object O. In some embodiments, a 3D location of object O and/or various points on object O with respect to vessel 10 can be determined (e.g., by a sensor processor 70) using the location of object O and/or various points on object O determined by one or more of proximity sensors 72-78. In some embodiments, a calibration process can be performed to determine a set of transforms that can be used to convert a location from a local coordinate system used by a particular proximity sensor to the corresponding location in a global coordinate system used by vessel 10 (e.g., used to perform autonomous navigation processes, such as automatically guiding vessel 10 during docking).

In some embodiments, a global coordinate system (sometimes referred to as global coordinates or world coordinates) can be defined relative to a particular point on vessel 10. For example, locations of points in an environment of vessel 10 can be defined based on the distance from a predetermined point, such as center of gravity (COG) or center of rotation (COR) of vessel 10. In some embodiments, the global coordinate system can use any suitable type of coordinate system, such as a 3D Cartesian coordinate system, a spherical coordinate system, a cylindrical coordinate system, etc.

In FIG. 1, the proximity sensors shown are positioned to observe multiple regions around vessel 10, including the front, sides, and stern of vessel 10, and include a front-facing sensor 72, a starboard-facing sensor 74, a rear-facing sensor 76, and a port-facing sensor 78. In some embodiments, one or more proximity sensors can be placed on a hard top of marine vessel 10 and arranged such that the fields of view of the one or more proximity sensors, combined, cover the entire 360° area surrounding vessel 10 (although there may be blind spots relatively close to vessel 10 (e.g., where the hull obstructs the field of view). Note also that the relevant controller, such as sensor processor 70, can selectively operate any one or more of a plurality of sensors (e.g., including depth cameras, radars, lidars, ultrasonics, or any other suitable sensor technology) to sense the location of objects in an environment of vessel 10. Note that the global coordinate system can be independent and distinct from a geographical coordinate system of latitude and longitude often used to designate locations on Earth.

In some embodiments, sensor processor 70 can integrate sensor data provided from one or more types of sensor into one or more models of an environment of vessel 10, objects within the environment, and/or vessel 10 itself. In such embodiments, the model(s) can be in any suitable format, such as one or more point clouds, one or more maps, and/or one or more occupancy grids integrating location information from multiple sensors. As described above, the location data from different sensors can be translated into a common reference frame (e.g., defined by the global coordinate system).

Autonomous and/or advanced operator assistance (sometimes referred to as semi-autonomous) controls for improved vessel handling qualities generally requires a relatively accurate ability to identify objects in an environment of vessel 10, often using multiple proximity sensors mounted on vessel 10. In general, such proximity sensors can be positioned to detect the objects in the marine environment surrounding marine vessel 10, such as a dock, a swimmer, or other obstruction in the current path and/or other potential paths of vessel 10. Each sensor can provide location information of features within its field of view relative to its own frame of reference and/or in a common frame of reference (e.g., in the global coordinate system). To create a cohesive dataset that can be used for purposes of vessel control and vessel navigation, including autonomous vessel navigation and automatic maneuver-limiting control (e.g., velocity limiting for object avoidance, maintenance of a buffer zone, etc.), information from multiple sources (e.g., multiple proximity sensors, multiple types of proximity sensors, etc.), can be translated to a common reference frame.

In some embodiments, vessel 10 can have a main inertial measurement unit (IMU) installed at a known location on the marine vessel. Referencing the example in FIG. 1, main IMU 36 can be part of an inertial navigation system (INS) such as including one or more micro-electro-mechanical systems (MEMS). For example, INS 60 can include a MEMS angular rate sensor, such as a rate gyro, a MEMS accelerometer, and a magnetometer. Such INS systems are well known in the relevant art. Additionally or alternatively, in some embodiments, motion and angular position (including pitch, roll, and yaw) can be sensed by a differently configured INS 60, or by an attitude heading reference system (AHRS) that provides 3D orientation of vessel 10 by integrating gyroscopic measurements, accelerometer data, and magnetometer data. In some embodiments, INS 60 can receive orientation information from main IMU 36 and can also receive information from a GPS receiver 40 comprising part of a satellite-based radio navigation system, such as the global positioning system (GPS). GPS receiver 40 can be located at a pre-selected fixed position on vessel 10, which provides information related to a position of vessel 10 with respect to a planetary frame of reference (e.g., latitude, longitude, and height with respect to sea level). In some embodiments, main IMU 36 can also be located at a known and fixed position with respect to the center of rotation (COR) and/or center of gravity (COG) of vessel 10 (e.g., a COG when the vessel is empty).

In some embodiments, IMU data from each sensor IMU 62-68 and/or main IMU 36 can be provided to sensor processor 70 and/or to another controller (e.g., CCM 24, INS 60, etc.). For example, the IMU data from each sensor IMU 62-68 can be transmitted along with the feature location information from the respective proximity sensor 72-78. Additionally or alternatively, in some embodiments, each sensor IMU 62-68 can have an integrated microprocessor configured to process the respective sensor IMU data and compare the sensor IMU data to main IMU data and determine whether the sensor IMU data is inconsistent with the main IMU data based on the relative location of the sensor IMU with respect to main IMU 36. In some embodiments, as shown in FIG. 1, object location data and/or IMU data can be communicated to sensor processor 70 (and/or any other suitable controller), which can be via any suitable wired or wireless communication technique(s), such as via a dedicated communication bus, wireless transmission protocols (e.g. Bluetooth, Bluetooth Low Energy, ZigBee, etc.), a CAN bus comprising part of the vessel network, etc. Note that the dashed lines in FIG. 1 are meant to show only that the various control elements are capable of communicating with one another, and do not necessarily represent actual wiring connections between the control elements, nor do they represent the only paths of communication between the elements.

In some embodiments, some sensor processing functions can be performed by a separate computing device. For example, sensor processor 70 can communicate processed sensor data to central controller 24, which can utilize the processed data for navigation functions and/or other vessel control functions. In some embodiments, sensor processor 70 can be a dedicated, special-purpose computing system configured to process object location data and/or IMU data from proximity sensors 72-78, sensor IMUs 62-68, and/or main IMU 36. As described below, in some embodiments, sensor processor 70 can be associated with its own storage system comprising memory and its own processing system that executes programs and accesses data stored in the memory of sensor processor 70. Additionally or alternatively, in some embodiments, one or more functions described as being performed by sensor processor 70 can be incorporated in a multi-purpose controller, such as sensor processor software stored and executed within controller 24.

For example, in some embodiments, controller 24 can control marine vessel navigation, such as autonomous point-to-point navigation, automatic docking, or other advanced operator assistance programs. In some embodiments, central controller 24 can also perform one or more sensor processing functions. Additionally or alternatively, in some embodiments, functions described herein as comprising part of the sensor processor functions can be distributed across two or more processing devices. For example, each sensor 72-78 can include one or more processors that are configured to perform certain functions (e.g., segmenting image data to classify one or more objects in the image, generate one or more RGBD images, generate one or more 3D depth maps, generate a point cloud corresponding to the 3D depth map, project points into a global coordinate system).

Autonomous and semi-autonomous vessel control systems for operating in marine environments can present challenges that are particular to such applications where marine vessels have additional degrees of freedom of movement compared to conventional automotive applications—for example, marine vessels can be configured to effectuate movements in only lateral and yaw directions without any forward or reverse movement (e.g., in a joysticking mode). Additionally, marine environments pose unique external environmental factors acting on the marine vessel, such as current, wind, waves, etc., that are not present in automotive applications (or can be essentially ignored, in the case of wind). Additionally, movements of a marine vessel can impact others nearby (e.g., nearby boats, nearby unpowered craft such as kayaks and canoes, nearby swimmers, etc.) at a distance, for example, via a wake created by the movement of the marine vessel. A human operator can be expected to account for the presence of others nearby when operating a marine vessel to minimize the impact of the marine vessel's movements on those nearby, and others expect operators of marine vessels to take this potential impact into consideration. Failure to do operate as expected may be considered rude and/or irresponsible, even if it does not cause any harm. In some embodiments, mechanisms described herein can facilitate autonomous navigation of a marine vessel that is more in line with expectations as it moves through a busy marine environment, for example, by slowing down to mitigate its impact on others that may be present.

In some embodiments, sensor processor 70 can be programmed (and/or otherwise configured) to automatically perform a process for setting a velocity limit based on objects near vessel 10. In some embodiments, sensor processor 70 (and/or any other suitable processor(s)) can analyze proximity information about a local area near vessel 10, and determine whether to impose a particular velocity limit based on the presence of objects within the local area that may not be directly in a planned path of vessel 10. For example, sensor processor 70 can analyze a portion of an occupancy grid near vessel 10, and if there are any objects present within the local area near vessel 10, sensor processor 70 can set a velocity limit that limits vessel 10 from autonomously moving at a higher velocity than the limit along the planned path. In a more particular example, as the number of objects within a local area of vessel 10 increases and/or as a the portion of the local area that is occupied increases, sensor processor 70 can impost successively lower velocity limits.

Additionally or alternatively, in some embodiments, sensor processor 70 (and/or any other suitable processor(s)) can analyze proximity information about a local area near vessel 10, and determine whether to impose a particular velocity limit based on the presence of particular types of objects within the local area that may not be directly in a planned path of vessel 10. For example, sensor processor 70 can analyze a portion of an occupancy grid near vessel 10, and if there are any instances of particular types of objects (e.g., objects that are sensitive to velocity and/or wake) present within the local area near vessel 10, sensor processor 70 can set a velocity limit that limits vessel 10 from autonomously moving at a higher velocity than the limit along the planned path. In a more particular example, sensor processor 70 can use classification information associated with an occupancy grid to determine what types of objects are present within the local area. If there are any objects that fall within one or more specific classification (e.g., a class encompassing swimmers, a class encompassing unpowered small vessels such as canoes or kayaks, etc.), sensor processor 70 can set a relatively low velocity limit to mitigate the probability that vessel 10 will impact the swimmer (e.g., by moving too quickly past a swimmer or kayaker). If there are any objects that fall within one or more other specific classification (e.g., a class encompassing similarly sized vessels to vessel 10), sensor processor 70 can set a higher velocity (e.g., higher than the relatively low limit, and lower than a limit if there are no objects near vessel 10) limit to mitigate the probability that vessel 10 will impact the other objects.

In some embodiments, vessel 10 can be configured to autonomously control propulsion devices 12*a*, 12*b* to maintain a velocity that is no greater than a set maximum velocity (e.g., based on a buffer distance between the marine vessel 10 and an object O, as described below in connection with FIG. 2, based on objects near vessel 10, etc.). In some embodiments, a propulsion controller, such as central controller 24, executing velocity control software 25, can operate to control a maximum velocity of vessel 10.

In some embodiments, a velocity limit calculation can be executed by one or more controllers within control system 20. For example, sensor processor 70 can receive proximity measurements and/or proximity information from proximity sensors 72-78, and can be configured with software to determine a velocity limit based on objects in a predetermined area around vessel 10, and can provide a velocity limit based on objects around vessel 10 to a controller configured to control propulsion (e.g., central controller 24).

In some embodiments, a controller performing a velocity limit determination can be referred to as a propulsion controller, which can be any controller configured to execute velocity control software 25 having computer-executable instructions to cause that controller to perform as described herein (e.g., executing at least a portion of process 500 and/or process 600 described below in connection with FIGS. 5 and 6). For example, in FIG. 1, CCM 24 storing and executing velocity control software instructions 25 can act as a propulsion controller. In such an example, each of sensor processor 70 and central controller 24 can includes its own storage system comprising memory and its own processing system that executes programs and accesses data stored in the respective storage system.

As another example, sensor processor 70 can store and execute velocity control software 25 and can act as a propulsion controller. As yet another example, a dedicated, special-purpose propulsion controller can be provided, such as a computing system storing and executing velocity control software 25 and configured to receive proximity measurements and/or proximity information, such as from the sensor processor 70, and to output velocity limits, which in various embodiments can be provided to CCM 24 or to each PCM 26*a*, 26*b*. As yet another example, proximity measurements and/or proximity information, determination of velocity limits, and propulsion control can be performed by a single controller, such as central controller 24.

Figure 2:
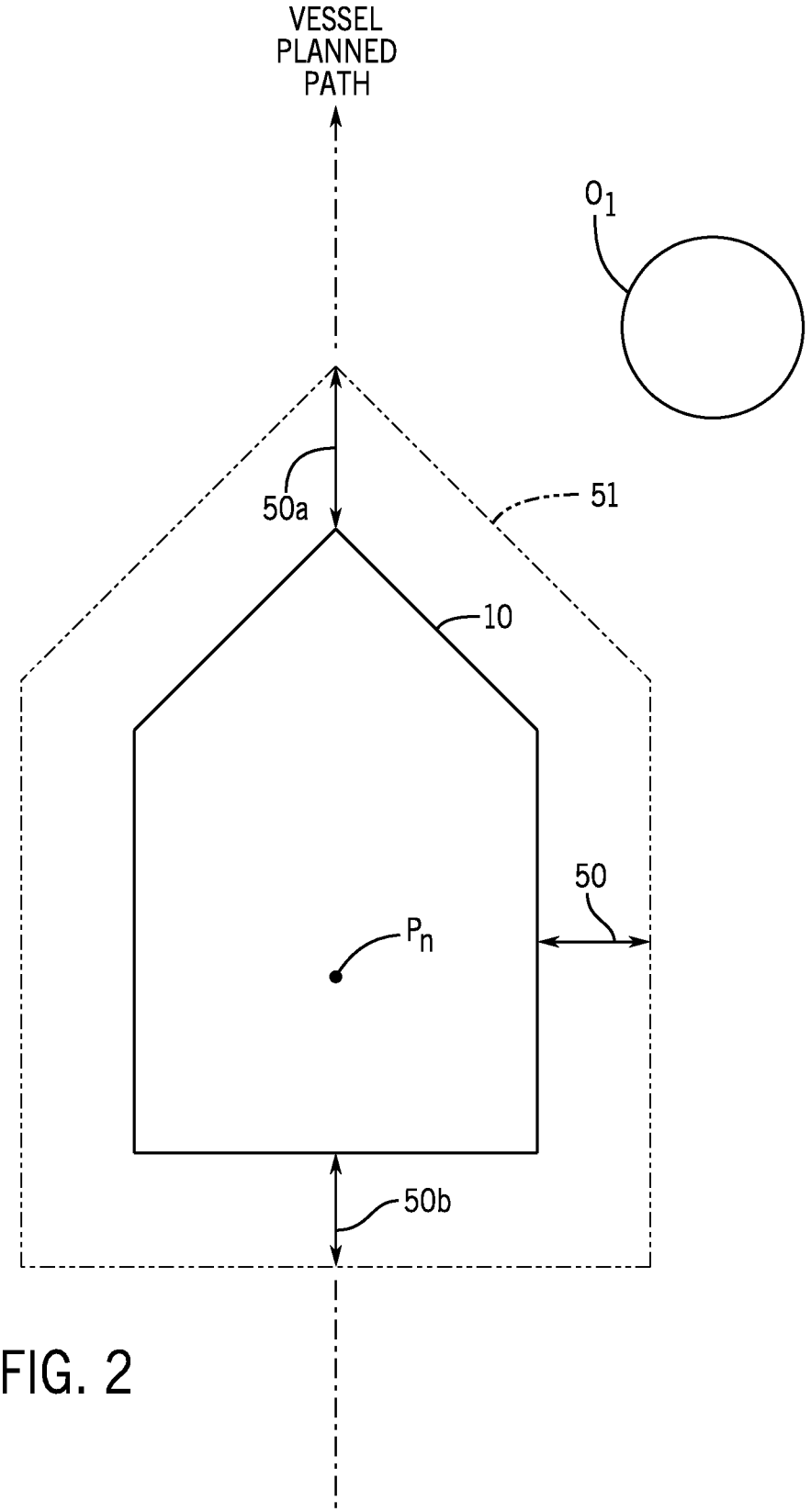
FIG. 2 shows an example of a buffer distance that can be maintained between a marine vessel and an object in accordance with some embodiments of the disclosed subject matter.

FIG. 2 shows an example of a buffer distance that can be maintained between a marine vessel and an object in accordance with some embodiments of the disclosed subject matter. In the example in FIG. 2, marine vessel 10 can be configured to maintain at least a predetermined buffer distance 50 from any objects (e.g., object O). A buffer zone 51 can be defined around marine vessel 10, and velocity limits can be calculated in order to progressively decrease the vessel velocity as it approaches a preset buffer distance 50 from object O. In some embodiments, buffer zone 51 can be established at a preset buffer distance 50 that is equal around all sides of the marine vessel, as shown in FIG. 2. Alternatively, in some embodiments, buffer zone 51 can be asymmetrical with respect to the marine vessel, such as to provide a greater buffer distance 50*a* at the front side of the marine vessel than a buffer distance 50*b* on the rear side of the marine vessel. Similarly, a buffer distance on the starboard and port sides of marine vessel 10 may be set the same or different than front and rear buffer distances 50*a*, 50*b*.

In some embodiments, a two-dimensional vessel outline and/or buffer area 51 can be represented as a set of Cartesian points defined with respect to a point of navigation $P_n$ (e.g., a COG or COR). For example, the two-dimensional vessel outline may be a set of five points forming the shape of a pentagon around $P_n$, where a center point is the navigation point $P_n$ of the marine vessel.

In some embodiments, during autonomous or semi-autonomous control of vessel 10 (e.g., as effectuated by controller 24), buffer area 51 can be used to determine whether any objects (e.g., object $O_1$) are in a planned path of vessel 10, and control propulsion of vessel 10 to avoid colliding with the object(s).

In some embodiments, a controller or combination of controllers (e.g., controller 24 and/or sensor processor 70, etc.), can calculate a path for autonomous navigation between a current location of vessel 10 and a target location, such as a particular position at a dock, a particular slip, a particular location in open water, etc. In some embodiments, the controller(s) can use any suitable technique or combination of techniques to calculate a path for vessel 10, and using any suitable information. For example, the controller(s) can calculate a long-term path between the current position of the vessel and the target location, or between the current position of the vessel and an intermediate point along a route from the current position to the target location (e.g., if the target location is sufficiently distance, such as more than several hundred meters from the current positions). In a more particular example, the controller(s) can calculate a long-term path for vessel 10 using a relatively simple model of vessel 10 (e.g., modeling vessel 10 as a circle having a diameter equal to a dimension of vessel 10 (e.g., a longest dimension, which can be based on an assumption that vessel 10 can move laterally; a width, which can be based on an assumption that vessel 10 can be expected to move predominantly in forward and reverse direction). In such an example, the dimension used can be a dimension including buffer distance around vessel 10.

As another example, the controller(s) can calculate a shorter-term path corresponding to a predetermined portion of a long-term path. In a more particular example, the controller(s) can calculate a shorter-term path for vessel 10 using a more complex model of vessel 10 (e.g., modeling vessel 10 as having dimensions of buffer area 51, evaluating the swept area of the boat during maneuvers). Additionally, the controller(s) can plan the shorter-term path based on the cost (e.g., in terms of energy expended) of particular maneuvers to be performed by vessel 10.

In some embodiments, the controller(s) can calculate the long-term path and/or short-term path using multiple constraints. For example, the controller(s) can calculate a path that avoids colliding with any objects, and that has a lowest cost within a time budget allotted to reach the target location (or an intermediate location in a route to the target location).

In some embodiments, the controller(s) can calculate a long-term and/or shorter-term path periodically (e.g., at regular and/or irregular intervals) based on the then current location of vessel 10. For example, the controller(s) can calculate and/or update a long-term and/or shorter-term path at regular intervals, such as after a predetermined amount of time has passed (e.g., after 5 seconds has elapsed, after 10 seconds has elapsed, etc.), or after vessel 10 has traversed a predetermined portion of the long-term and/or shorter-term path (e.g., after traversing 10 meters of the path, after traversing 20 meters of the path, etc.). As another example, the controller(s) can calculate and/or update a long-term and/or shorter-term path when a change in environment indicates that a different path may be needed (e.g., when an object has moved into the previously planned path, requiring that vessel 10 stop or change paths to avoid colliding with the object).

In some embodiments, the controller(s) can determine calculate one or more potential paths, and can compare a cost of the paths (e.g., to each other and/or to a currently planned path) to determine which path to traverse to reach the target location and/or an intermediate point.

In some embodiments, the controller(s) can use any suitable information about the environment when planning the path. For example, the controller(s) can use an occupancy grid that has been generated and/or updated using proximity information measured by proximity sensors (e.g., proximity sensors 72-78). In some embodiments, the occupancy grid can be formatted as a data structure in which each element corresponds to a cell of the occupancy grid, and each element is indicative of a probability that the cell is occupied by an object/obstacle. In some embodiments, each cell can represent a volume of the environment (e.g., having a width, depth, and height). For example, each cell can represent a volume that is 0.25 meters (m) by 0.25 m laterally, and extends from a water surface to a height at or above the top of vessel 10 (e.g., 3 m from the waters surface, 5 m from the water surface, etc.). In some embodiments, vessel 10 can gather location information corresponding to objects in the environment during operation (e.g., using proximity sensors 72-78), and can generate a model (e.g., using a point cloud) of objects in an environment around vessel 10 based on the location of the objects. The model of the objects in the environment can be used to identify cells in the occupancy grid that are more likely to contain an obstruction, and those that are less likely. For example, the model of the environment can be integrated over the volume of space represented by any particular occupancy grid, and can determine whether an object is located in that cell based on whether the model indicates the presence of an one or more objects within the volume (e.g., based on the number of point cloud points within the volume, based on the number of point cloud points within the volume excluding points corresponding to water, etc.).

In some embodiments, the controller(s) can update the occupancy grid in real-time based on recent measurements of a portion of the environment within a predetermined range of the proximity sensors(s). Portions of the occupancy grid that are out of that range can be maintained in memory (e.g., for use in planning a path through the portion of the environment represented by that portion of the occupancy grid in the future). In some embodiments, cells in the occupancy grid can be associated with local coordinates (e.g., based on the global coordinate system), and can be associated with a geographic coordinate system (e.g., latitude and longitude). In such an example, the local coordinates can be defined based on linear measurements indicating placement of the cell (e.g., distance from an origin along two or more axes) and/or radial measurements (e.g., radial distance from one or more axes). A transform can define a relationship between the local coordinates and the associated geographic coordinates. In some embodiments, when planning a path, the controller(s) can use the occupancy grid to identify portions of the environment that can be safely traversed and those that may result in a collision.

In some embodiments, the occupancy grid can include multiple layers (e.g., each cell can be associated with multiple elements) that indicate a probability that the cell is occupied by a particular type of object. For example, each cell can be associated with an element indicative of a probability of any object being present in the cell. As another example, each cell can be associated with an element indicative of a probability of a person being present in the cell. As yet another example, each cell can be associated with an element indicative of a probability of a powered boat being present in the cell. As yet another example, each cell can be associated with an element indicative of a probability of a human-powered vessel (e.g., a kayak, a canoe, a row boat, a paddle boat, a stand-up paddle board, etc.) being present in the cell. As yet another example, each cell can be associated with an element indicative of a probability of a small vessel (e.g., a boat or other powered vessel, such as a jet ski, under a particular size) being present in the cell. As still another example, each cell can be associated with elements indicative of a probability of other types of objects and/or obstructions being present in the cell, such as land, a dock, a structure (e.g., a bridge, a pier, a post, a piling, etc.), vegetation, floating vegetation, miscellaneous debris, floating logs, etc.

In some embodiments, information indicating a probability of an object occupying a cell can be based on any suitable information. For example, location information (e.g., based on measurements by proximity sensors 72-78) can be correlated with feature label information that identifies a classification of a feature. In some embodiments, the label information can be generated using any suitable technique or combination of techniques. For example, one or more images of an environment (e.g., color images) can be captured, and can be used to generate segmentation information (e.g., using a trained machine learning model), which can include classification information that indicates which of a set of classes different portions of the image are most likely to correspond. In some embodiments, the set of classes can include classes that are relatively likely for the vessel to encounter (e.g., in a marine environment). As another example, one or more images of an environment can be captured, and can be used to generate object detection information (e.g., using a trained machine learning model), which can include classification information that indicates which of a set of classes particular portions of the image are most likely to correspond (e.g., instances of a particular class of the set of classes). In some embodiments, classification information associated with objects in the environment can be associated with portions of a model used to represent the environment. For example, points in a point cloud can be assigned a label based on a classification of an object at that position. Additionally, in some embodiments, the classification information can include a confidence that the label is accurate (e.g., a probability of the portion of the image being an instance of the class corresponding to the label). In some embodiments, such a label can be used to determine a likelihood that a particular type of object is located at different points in the environment. For example, if a volume of the environment corresponding to a particular cell of an occupancy grid includes points labeled as person, a layer of the occupancy grid corresponding to people can include an element corresponding to a likelihood that a person is present in that portion of the environment based on the label. As another example, if a volume of the environment corresponding to a particular cell of an occupancy grid includes points labeled as human-powered vessel (or some more particular class that is an instance of a human-powered vessel, such as kayak or canoe), a layer of the occupancy grid corresponding to human-powered vessels can include an element corresponding to a likelihood that a human-powered vessel is present in that portion of the environment based on the label.

In some embodiments, as vessel 10 traverses the planned path, the controller(s) can periodically (e.g., at regular and/or irregular intervals) project a model of vessel 10 forward along the path a predetermined distance to determine whether vessel 10 is likely to collide with any obstacles that may have obstructed the planned path (and/or that a proximity sensor(s) may have detected the presence of) since the path was planned. For example, at a predetermined rate (e.g., once per second, twice per second, etc.), the controller(s) can determine whether a cell of the occupancy grid which vessel 10 (e.g., including buffer area 51) is predicted to traverse is occupied. If the controller(s) determines that a cell of the occupancy grid that vessel 10 is predicted to traverse is occupied, the controller(s) can initiate replanning of a route that avoids that cell and/or can control propulsion of vessel 10 to avoid colliding with the object (e.g., by slowing down, stopping, reversing, etc.).

In some embodiments, the controller(s) can use any suitable technique or combination of techniques to determine a velocity at which to propel vessel 10 at a current point along the planned path such that the vessel can be safely stopped when a target is reached, or such that the vessel can safely execute a particular maneuver (e.g., a turn, a sway, a lateral movement, etc.) when it reaches a point along the path (e.g., the shorter-term path) at which the particular maneuver is planned. For example, the controller(s) can utilize model predictive control (MPC) techniques to determine a target velocity based on various constraints and/or parameters, and/or to determine an amount of thrust to apply. For example, the controller(s) can determine an amount of thrust to apply to achieve a target velocity based on a predicted deceleration due to water drag along the direction of motion (e.g., which is generally proportional to velocity when a boat is not on plane, and can differ along each side of the vessel).

In some embodiments, the controller(s) can enforce a velocity limit during autonomous operation, where the velocity limit can be based on the type of autonomous navigation that is being performed. For example, during an automatic docking process (e.g., in which the controller(s) can be configured to autonomously navigate through a relatively complex marina to a designated docking location) a velocity limit can be relatively low (e.g., on the order of 2 meters/second (m/s), a no-wake speed (about 2.23 m/s or 5 miles per hour in some jurisdictions), an idle speed of the vessel, etc.). In some embodiments, as vessel 10 approaches a target location (e.g., a designated docking location), the controller(s) can be configured to impose a lower velocity limit (e.g., on the order of 1 m/s, an idle speed of the vessel if below the higher velocity limit, etc.). For example, when vessel 10 is within 25 meters of a destination, the controller can begin imposing a 1 m/s velocity limit (or other suitable velocity limit).

Figure 3A:
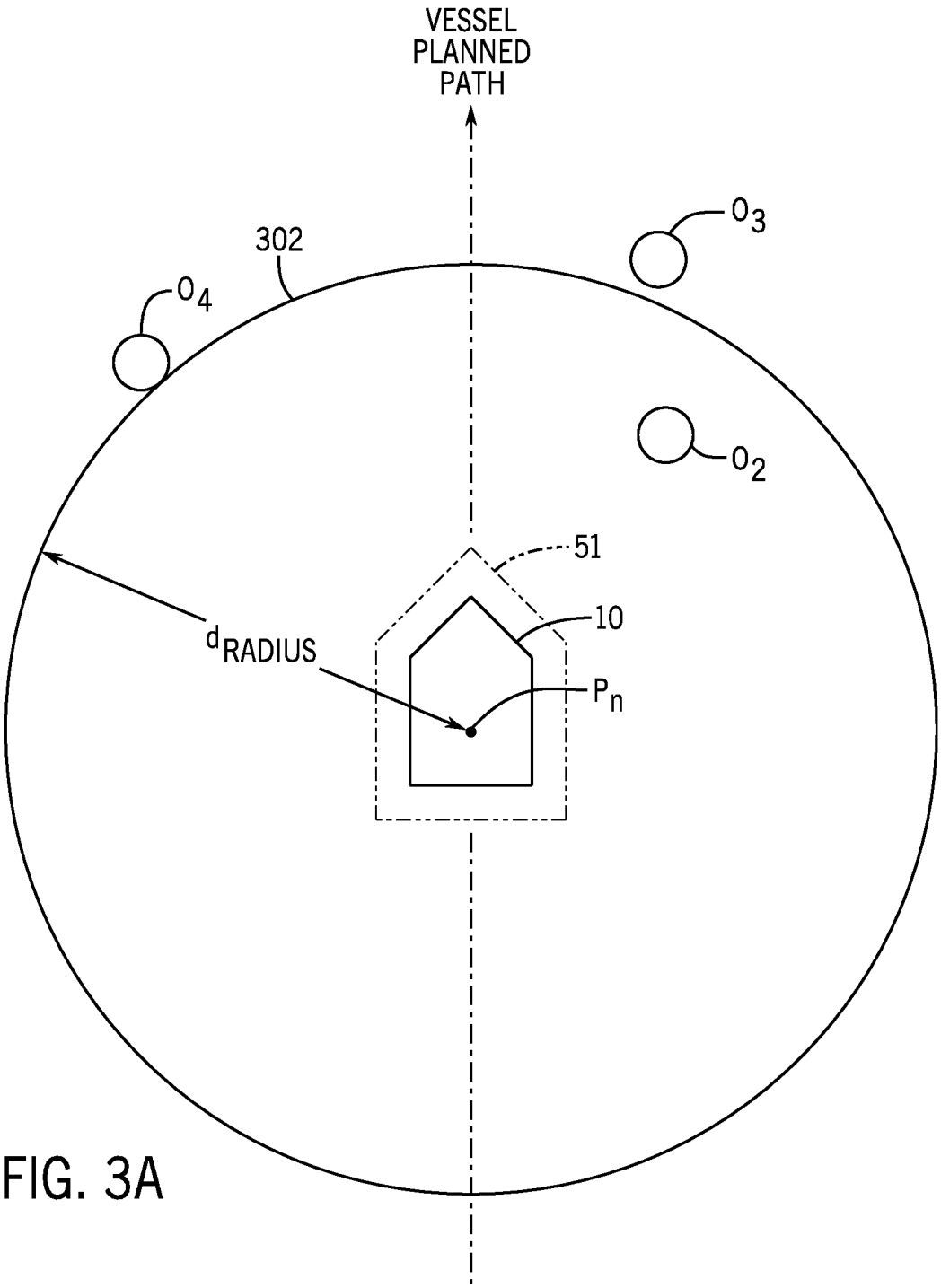
FIG. 3A shows an example of a circular local consideration zone that can be analyzed for objects along a planned path of a marine vessel in accordance with some embodiments of the disclosed subject matter.

FIG. 3A shows an example of a circular local consideration zone that can be analyzed for objects along a planned path of a marine vessel in accordance with some embodiments of the disclosed subject matter.

FIGS. 3B1 and 3B2 shows an example of a rectangular local consideration zone that can be analyzed for objects along a planned path of a marine vessel in accordance with some embodiments of the disclosed subject matter.

In some embodiments, mechanisms described herein can analyze a relatively large area around vessel (e.g., larger than a buffer area, such as buffer area 51) to determine whether to impose a lower velocity limit based on objects near the vessel (e.g., vessel 10) that may not be directly along a planned path of the vessel. For example, as described below in connection with FIGS. 5 and 6, a controller(s) can determine whether to impose a particular velocity limit (e.g., a velocity limit lower than a maximum velocity imposed based on other constraints, such as the type of autonomous navigation task that is being performed) based on a number of objects, a density of objects, and/or a type of object in a vicinity of the vessel.

In some embodiments, controlling propulsion to slow the vessel when a number of objects, a density of objects, and/or a type of object in a vicinity of the vessel can facilitate reactions by the vessel to changes in an environment (e.g., due to moving objects) and/or can facilitate more considerate autonomous navigation by vessel 10 (e.g., navigation that others are less likely to consider rude, as it is less likely to inconvenience or harm others in a vicinity of vessel 10) when vessel 10 is near objects that are sensitive to the presence of vessel 10 and/or to a wake of vessel 10 (e.g., docked boats, smaller vessels, human-powered vessels, swimmers, etc.).

In some embodiments, a controller(s) can analyze a portion of an occupancy grid corresponding to a predetermined area around vessel 10 and/or corresponding to a predetermined area along a planned path of vessel 10 to determine whether to impose a velocity limit based on a number of objects, a density of objects, and/or a type of object in a vicinity of the vessel.

In some embodiments, the area being considered (sometimes referred to herein as a local consideration zone) can have any suitable shape, and the shape may depend on a current direction and/or velocity of the vessel. For example, as shown in FIG. 3A, a circular local consideration zone 302 can defined by a radius $d_{radius}$ from a point of navigation $P_n$. In such an example, a controller(s) can analyze objects that fall at least partially within local consideration zone 302 (e.g., objects $O_2$, but not object $O_3$ or $O_4$) to determine whether a lower maximum velocity is indicated. In a more particular example, the controller(s) can determine which cells of an occupancy grid correspond to an area of the environment that falls within local consideration zone 302, and can determine whether a lower maximum velocity is indicated based on elements associated with those cells. In some embodiments, radius $d_{radius}$ can be any suitable magnitude. For example, $d_{radius}$ can be in a range of about 10 m to about 25 m. Additionally, in some embodiments, radius $d_{radius}$ can vary based on conditions (e.g., based on current velocity; based on a current type of navigation being performed, etc.). For example, as the current velocity increases, the magnitude of radius $d_{radius}$ can increase. As another example, in a navigation mode associated with docking, a relatively small radius can be used, and in a navigation mode associated with point-to-point navigation a larger radius can be used.

As another example, as shown in FIG. 3B1, an elongate local consideration zone 304 can defined by multiple parameters, such as a lateral distance $d_{lateral}$ from a point of navigation $P_n$ and/or a planned path of the vessel, and front distance $d_{ahead}$ that extends from a point of navigation $P_n$ in a fore direction, and a rear distance $d_{behind}$ that extends from a point of navigation $P_n$ in an aft direction. In such an example, a controller(s) can analyze objects that fall at least partially within local consideration zone 304 (e.g., objects $O_2$ and $O_3$, but not object $O_4$) to determine whether a lower maximum velocity is indicated. In a more particular example, the controller(s) can determine which cells of an occupancy grid correspond to an area of the environment that falls within local consideration zone 304, and can determine whether a lower maximum velocity is indicated based on elements associated with those cells. In some embodiments, $d_{lateral}$, $d_{behind}$, and $d_{ahead}$ can be any suitable magnitude. For example, $d_{lateral}$ can be in a range of about 5 m to about 15 m, $d_{behind}$ can be in a range of about 5 m to about 15 m, and $d_{ahead}$ can be in a range of about 10 m to about 25 m. Additionally, in some embodiments, $d_{lateral}$, $d_{behind}$, and $d_{ahead}$ can vary based on conditions (e.g., based on current velocity; based on a current type of navigation being performed, etc.). For example, as the current velocity increases, the magnitude of each of $d_{lateral}$, $d_{behind}$, and $d_{ahead}$ can increase. As another example, in a navigation mode associated with docking, relatively small values for $d_{lateral}$, $d_{behind}$, and $d_{ahead}$ can be used, and in a navigation mode associated with point-to-point navigation larger values for $d_{lateral}$, $d_{behind}$, and $d_{ahead}$.

In some embodiments, values of $d_{lateral}$, $d_{behind}$, and $d_{ahead}$ can change based on a direction of travel. For example, if vessel 10 is traveling in reverse, $d_{behind}$ can be greater than $d_{ahead}$. As another example, if vessel 10 is traveling laterally a value of $d_{lateral}$ on a side corresponding to a direction of travel can be greater than $d_{lateral}$ on a side opposite to a direction of travel.

As yet another example, as shown in FIG. 3B2, a shape of local consideration zone 304 can conform to a shape of the planned path. In such an example, at a portion or a planned path that includes a curve, a lateral distance $d_{lateral}$ from the planned path of the vessel can be used to draw the shape of consideration zone 304 a distance $d_{ahead}$ along the path that extends from a point of navigation $P_n$ in a fore direction, and a distance $d_{behind}$ that extends from a point of navigation $P_n$ in an aft direction. In such an example, a controller(s) can analyze objects that fall at least partially within local consideration zone 304 (e.g., objects $O_2$, $O_3$, and $O_4$) to determine whether a lower maximum velocity is indicated. In a more particular example, the controller(s) can determine which cells of an occupancy grid correspond to an area of the environment that falls within irregularly shaped local consideration zone 304, and can determine whether a lower maximum velocity is indicated based on elements associated with those cells.

In some embodiments, $d_{lateral}$, $d_{behind}$, and $d_{ahead}$ can be defined relative to vessel 10. For example, $d_{ahead}$ can extend (e.g., along a planned path, along a traversed path if in reverse, perpendicular to a path if travelling laterally, straight out from the bow, etc.) from the bow of vessel 10, $d_{behind}$ can extend (e.g., along a traversed path, along a planned path if in reverse, perpendicular to a path if travelling laterally, straight out from the stern, etc.) from the stern of vessel 10, and $d_{lateral}$ can extend to the port and starboard sides of vessel 10. In such an example, the various values can be defined consistently regardless of a direction of travel.

Alternatively, in some embodiments, $d_{lateral}$, $d_{behind}$, and $d_{ahead}$ can be defined relative to movement of vessel 10. For example, $d_{ahead}$ can extend along a planned path in a direction of travel, $d_{behind}$ can extend along a traversed path or straight back from a direction of travel, and $d_{lateral}$ can extend perpendicular to the planned path and traversed path (or perpendicular to a line straight back from a direction of travel). In such an example, the various values can be defined relative to a current direction of travel, and may not always correspond to the same portion of vessel 10.

In some embodiments, a local consideration zone can have any other suitable shape. For example, a local consideration zone can have an ellipse shape. In a more particular example, the ellipse can be drawn to have vessel 10 at one focus (e.g., with the other focus being forward of vessel 10). As another more particular example, the ellipse can be drawn to have vessel 10 at a center of the ellipse.

As another example, a local consideration zone can have a complex shape, such as a multi-lobed shape, e.g., three overlapping ellipses with vessel 10 at a first focus of each ellipse, and each ellipse can have a second focus forward of vessel 10, offset by a predetermined angle.

In some embodiments, mechanisms described herein can analyze objects (e.g., a number of objects, a portion of the local area of consideration occupied by the objects, types of objects, etc.) within the local consideration zone. For example, mechanisms described herein can analyze objects that are not along the planned path of vessel 10 (e.g., objects that vessel 10 is not predicted to collide with), and can alter propulsion of the vessel based on the objects (e.g., an autonomous navigation mode, during semi-autonomous operation, etc.).

Figure 4:
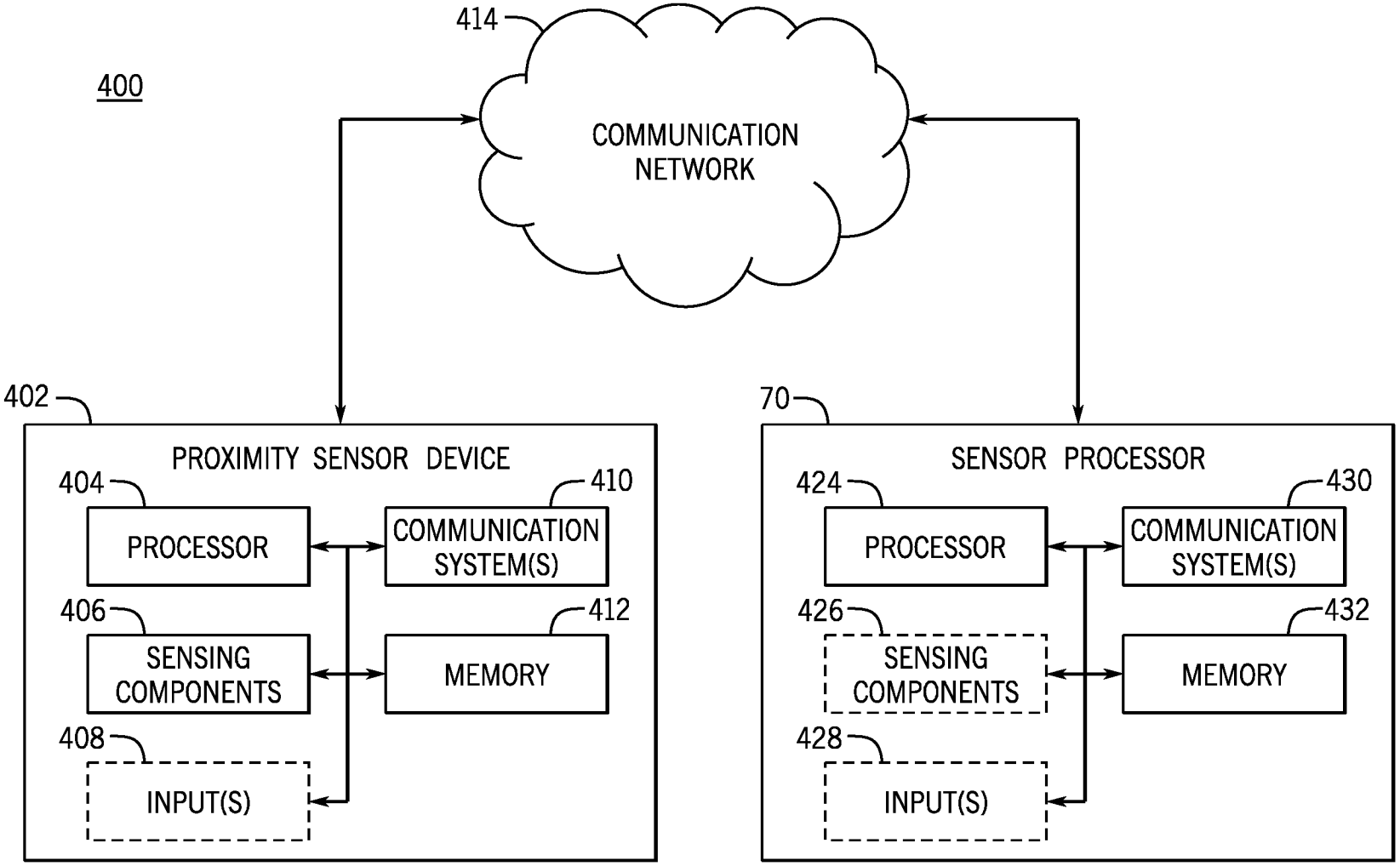
FIG. 4 shows an example of a system for hardware that can be used to implement a sensor device and sensor processor in accordance with some embodiments of the disclosed subject matter.

FIG. 4 shows an example of hardware 400 that can be used to implement a proximity sensor device 402 and sensor processor 70 in accordance with some embodiments of the disclosed subject matter.

As shown in FIG. 4, in some embodiments, proximity sensor device 402 can include a processor 404, sensing components 406, one or more inputs 408, one or more communication systems 410, and/or memory 412. In some embodiments, processor 404 can be any suitable hardware processor or combination of processors, such as a central processing unit (CPU), an accelerated processing unit (APU), a graphics processing unit (GPU), a field programmable gate array (FPGA), an application specific integrated circuit (ASIC), etc.

In some embodiments, sensing components can include components that are used to determine a three-dimensional location of an object and/or other feature of an environment (e.g., a water surface) that is within a field of view of proximity sensor device 402. In some embodiments, proximity sensor device 402 can include components used to implement one or more of proximity sensors 72-78.

For example, proximity sensor device 402 can be implemented as one or more cameras that include components that facilitate three-dimensional imaging of a region of an environment, such as a stereoscopic camera, a structured light camera, a continuous-wave time-of-flight camera, a direct time-of-flight camera, etc. As another example, proximity sensor device 402 can be implemented as one or more lidar devices (e.g., a scanning lidar, a lidar including a 2D array sensor, etc.) that include components that facilitate three-dimensional characterization of a region of an environment. As yet another example, proximity sensor device 402 can be implemented as one or more sound-based devices (e.g., one or more sonar systems, etc.) that include components that facilitate three-dimensional characterization of a region of an environment. As still another example, proximity sensor device 402 can be implemented as one or more radio wave-based devices (e.g., one or more radar systems, etc.) that include components that facilitate three-dimensional characterization of a region of an environment.

In some embodiments, inputs 408 can include any suitable input devices and/or sensors that can be used to receive user input, such as a keyboard, a mouse, a touchscreen, a touchpad, a microphone, a camera, etc. In some embodiments, proximity sensor device 402 can omit inputs (e.g., where proximity sensor device 402 is an embedded device, or where proximity sensor device 402 is not configured for direct end user operation).

In some embodiments, communications systems 410 can include any suitable hardware, firmware, and/or software for communicating information over a communication network 414 and/or any other suitable communication networks. For example, communications systems 410 can include one or more transceivers, one or more communication chips and/or chip sets, etc., that can be used to establish a wired and/or wireless communication link. In a more particular example, communications systems 410 can include hardware, firmware, and/or software that can be used to establish a direct or indirect wired connection and/or a direct or indirect wireless connection, such as a CAN bus connection, a Bluetooth connection, Bluetooth Low Energy connection, a ZigBee connection, a Wi-Fi connection, a cellular connection (e.g., an uplink connection, a downlink connection, or a sidelink connection), an Ethernet connection, etc.

In some embodiments, memory 412 can include any suitable storage device or devices that can be used to store instructions, values, etc., that can be used, for example, by processor 404 to generate location information of a portion of the environment that characterizes the portion of the environment in three-dimensions, to identify and/or classify one or more objects and/or other features in a scene based on the location information and/or image information, to communicate with sensor processor 70 via communications system(s) 410, etc. Memory 412 can include any suitable volatile memory, non-volatile memory, storage, or any suitable combination thereof. For example, memory 412 can include random access memory (RAM), read-only memory (ROM), electronically erasable programmable read-only memory (EEPROM), one or more flash drives, one or more hard disks, one or more solid state drives, one or more optical drives, etc. In some embodiments, memory 412 can have encoded thereon a computer program for controlling operation of proximity sensor device 402. In such embodiments, processor 404 can execute at least a portion of the computer program to generate location information, to identify and/or classify one or more objects and/or other features in a scene based on the location information and/or image information, to transmit information to sensor processor 70, to execute at least a portion of a process for setting a velocity limit based on objects within a local consideration zone around a marine vessel, such as processes described below in connection with FIGS. 5 and 6, etc.

In some embodiments, proximity sensor device 402 can include any suitable display device(s) (not shown), such as a computer monitor, a touchscreen, a television, etc.

In some embodiments, communication network 414 can be any suitable communication network or combination of communication networks. For example, communication network 414 can include a Wi-Fi network (which can include one or more wireless routers, one or more switches, and the like), a peer-to-peer network (e.g., a Bluetooth network), a cellular network (e.g., a 3G network, a 4G network, a 5G network, etc., complying with any suitable standard(s), such as CDMA, GSM, LTE, LTE Advanced, 5G NR, etc.), a wired network, etc. In some embodiments, communication network 414 can include one or more portions of a control area network (CAN), a local area network (LAN), a wide area network (WAN), a public network (e.g., the Internet, which may be part of a WAN and/or LAN), any other suitable type of network, or any suitable combination of networks. Communications links shown in FIG. 2 can each be any suitable communications link or combination of communications links, such as wired links, fiber optic links, Wi-Fi links, Bluetooth links, cellular links, etc.

In some embodiments, sensor processor 70 can include a processor 424, a display 426, one or more inputs 428, one or more communications systems 430, and/or memory 432. In some embodiments, processor 424 can be any suitable hardware processor or combination of processors, such as a CPU, an APU, a GPU, an FPGA, an ASIC, etc. In some embodiments, display 426 can include any suitable display devices, such as a computer monitor, a touchscreen, a television, etc. In some embodiments, inputs 428 can include any suitable input devices and/or sensors that can be used to receive user input, such as a keyboard, a mouse, a touchscreen, a microphone, etc. In some embodiments, sensor processor 70 can omit inputs (e.g., where sensor processor 70 is an embedded device that is not configured for direct user interaction). For example, sensor processor 70 can provide results of an analysis to CCM 24, and CCM 24 can use the results to assist with autonomous control and/or advanced operator assistance control.

In some embodiments, communications systems 430 can include any suitable hardware, firmware, and/or software for communicating information over communication network 414 and/or any other suitable communication networks. For example, communications systems 430 can include one or more transceivers, one or more communication chips and/or chip sets, etc., that can be used to establish a wired and/or wireless communication link. In a more particular example, communications systems 430 can include hardware, firmware, and/or software that can be used to establish a direct or indirect wired connection and/or a direct or indirect wireless connection, such as a CAN bus connection, a Bluetooth connection, Bluetooth Low Energy connection, a ZigBee connection, a Wi-Fi connection, a cellular connection (e.g., an uplink connection, a downlink connection, or a sidelink connection), an Ethernet connection, etc.

In some embodiments, memory 432 can include any suitable storage device or devices that can be used to store instructions, values, etc., that can be used, for example, by processor 424 to analyze object location information received from proximity sensor device 402 (and/or any other suitable proximity sensor device), to identify and/or classify one or more objects and/or other features in a scene based on the location information and/or image information, to communicate with proximity sensor device 402 via communications system(s) 430, etc. Memory 432 can include any suitable volatile memory, non-volatile memory, storage, or any suitable combination thereof. For example, memory 432 can include RAM, ROM, EEPROM, one or more flash drives, one or more hard disks, one or more solid state drives, one or more optical drives, and the like. In some embodiments, memory 432 can have encoded thereon a computer program for controlling operation of sensor processor 70. In such embodiments, processor 424 can execute at least a portion of the computer analyze object location information, to identify and/or classify one or more objects and/or other features in a scene based on the object location information and/or image information, to receive information from proximity sensor device 402, to execute at least a portion of a process for setting a velocity limit based on objects within a local consideration zone around a marine vessel, such as processes described below in connection with FIGS. 5 and 6, etc.

Figure 5:
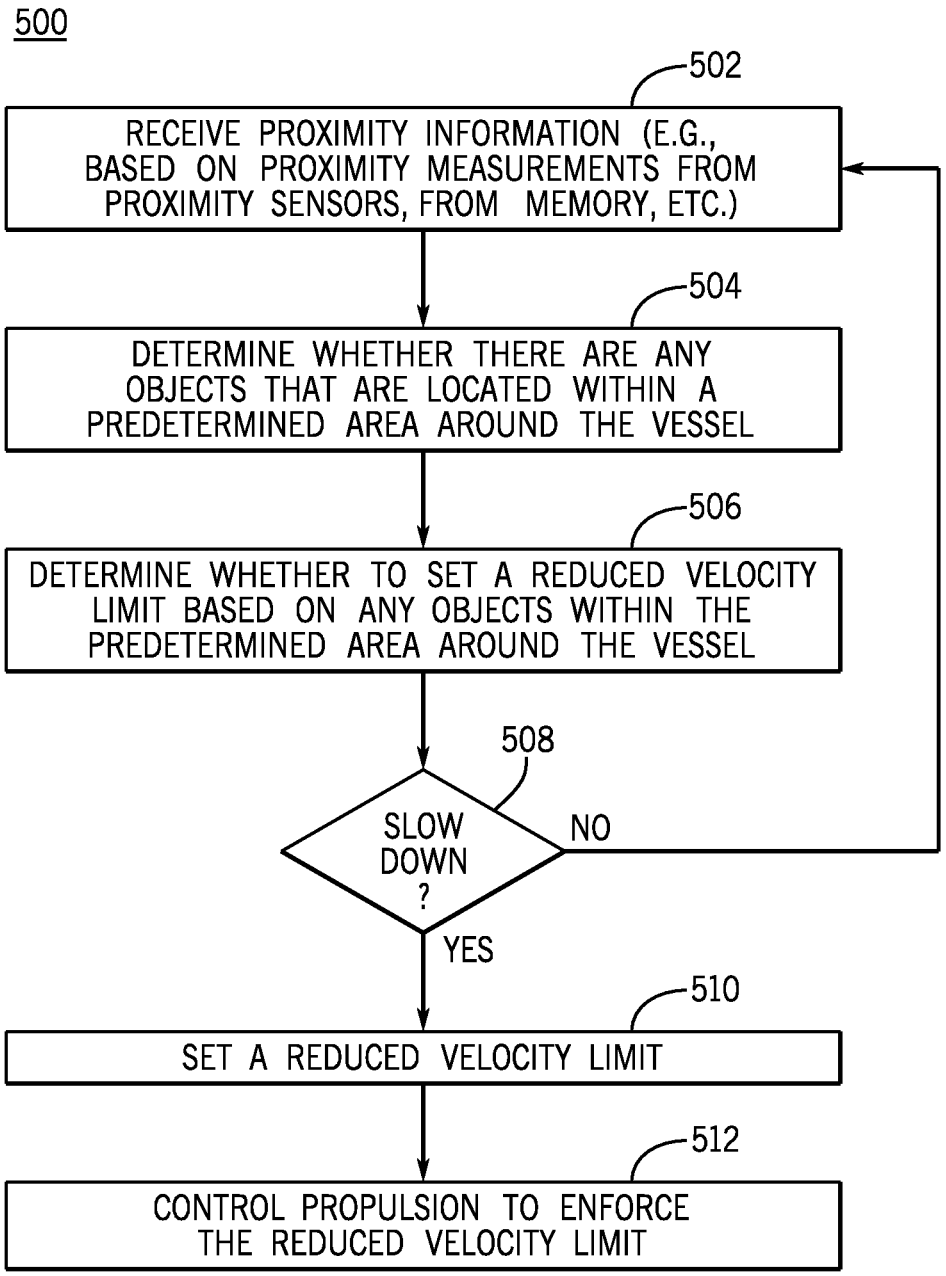
FIG. 5 shows an example of a process for setting a velocity limit based on objects within a local consideration zone around a marine vessel in accordance with some embodiments of the disclosed subject matter.

FIG. 5 shows an example of a process for setting a velocity limit based on objects within a local consideration zone around a marine vessel in accordance with some embodiments of the disclosed subject matter.

At 502, process 500 can receive proximity information that can be used to determine the position of objects in an area around a vessel (e.g., vessel 10) associated with process 500. In some embodiments, the proximity information can be based on proximity measurements generated by one or more proximity sensors (e.g., proximity sensors 72-78).

In some embodiments, the proximity information can have any suitable format and/or can be received in multiple formats. For example, the proximity information can be formatted as point cloud data (e.g., which can be labeled point cloud data as described above in connection with FIG. 2, or unlabeled point cloud data).

As another example, in some embodiments, the proximity information can be formatted as an occupancy grid (e.g., as described above in connection with FIGS. 1 and 2).

In some embodiments, process 500 can receive (and/or retrieve) the proximity information from any suitable source (e.g., from memory, such as memory 412 and/or memory 432; from a processor, such as processor 404 and/or processor 424; etc.).

At 504, process 500 can determine whether any objects are located within a predetermined area around a vessel (e.g., vessel 10) associated with process 500. In some embodiments, process 500 can determine whether any objects are in an area around vessel 10. For example, process 500 can determine whether any objects are within a local consideration zone (e.g., local consideration zone 302 or 304).

In some embodiments, process 500 can identify objects that are in a planned (and/or predicted) path of the vessel, and can identify objects 500 that are not in a planned (and/or predicted) path of the vessel. In some embodiments, process 500 can consider all objects within the predetermined area around the vessel. Alternatively, in some embodiments, process 500 can consider only objects that are within the predetermined area, and that are not in a planned (and/or predicted) path of the vessel.

In some embodiments, process 500 can be executed in parallel with a process that is used to determine whether the vessel associated with process 500 is predicted to collide with any objects along a planned (and/or predicted) path of the vessel.

In some embodiments process 500 can continuously (e.g., once per second, more often than once per second) monitor the predetermined area for objects that may be present near the vessel. For example, process 500 can analyze the proximity information received at 502.

In some embodiments, for example as described above in connection with FIGS. 3A to 3B2, the predetermined area (e.g., a local zone of consideration) can have any suitable shape. In some embodiments, the shape of the predetermined area and/or dimensions can be altered based on conditions. For example, process 500 can use a circular predetermined area (e.g., local consideration zone 302) when vessel 10 is moving less than (or less than or equal to) a threshold velocity (or not moving), and can use a different shaped local consideration zone (e.g., a rectangular-based predetermined area, such as local consideration zone 304) when vessel 10 is moving at greater than or equal to (or greater than) a threshold velocity. In some embodiments, a circular area can be used when travelling relatively slowly as the vessel can navigate in more directions when the velocity is relatively low (e.g., by turning in a relatively right radius, by executing a maneuver in a yaw direction without movement in a forward or aft direction or with relatively little movement in such a direction, by executing a lateral movement without movement in a forward or aft direction or with relatively little movement in such a direction). In some embodiments, an elongated area can be used when traveling at higher velocity and/or when the vessel is operating in a forward driving mode (such as where the marine drives 12*a*, 12*b* are steered in parallel), as the vessel can travel farther along a direction of movement (e.g., in a forward or aft direction) when already moving more quickly, and thus considering a greater area along of direction of movement can be useful. For example, in some embodiments, a circular area can be used when travelling below (or at or below) 2 m/s (or any other suitable velocity threshold, such as a no-wake speed, an idle speed of the vessel, etc.), and an elongated area can be used when travelling at or above (or above) 2 m/s (or any other suitable velocity threshold, such as a no wake speed, an idle speed of the vessel, etc.). As another example, a transition between a circular area and an elongated area can be proportional to velocity (e.g., starting at a first threshold and completing at a second threshold). In a more particular example, a transition between a circular area and an elongated area can begin as velocity increases (e.g., at 1.75 m/s), and the area can become more elongated as the velocity increases (e.g., up to 2.0 m/s). In such an example, the circular shape can be morphed into the elongate shape continuously with velocity. Additionally, as described above, dimensions of an elongated shape can continue to scale with velocity above the second threshold (e.g., while the overall ratio of dimensions may stay the same, or may change as the distance in front is elongated more than lateral distances).

At 506, process 500 can determine whether to set a reduced velocity limit based on any object within the predetermined area around the vessel. In some embodiments, process 500 can set a velocity limit based on the objects within the predetermined area around the vessel (e.g., based on a number of objects, a density of objects, a distribution of objects, and/or a type of object in a vicinity of the vessel).

In some embodiments, process 500 can determine whether there any objects of particular types (e.g., objects that are instances of a particular class) within the predetermined area around the vessel based on the proximity information, and can determine a velocity limit to set based on velocity limits associated with each type of object. For example, certain classes of objects (e.g., swimmers, human-powered vessel, etc.) can be associated with a relatively low maximum velocity, while other classes of objects (e.g., non-mobile inanimate objects, such as navigation aids, empty docks, etc.; mobile inanimate objects that are not associated with humans, such as logs, floating vegetation, floating trash, etc.) can be associated with no maximum velocity. In such an example, each class (or group of classes) can be associated with a respective maximum velocity that can cause vessel 10 to slow to a speed that may be considered a considerate (e.g., not rude, not dangerous) speed that is appropriate when that type of object is near the vessel. For example, when a swimmer is nearby, it may be considered rude or dangerous to travel at a speed above a threshold speed (e.g., a velocity greater than about 1-2 m/s, an idle speed for the vessel, etc.), as a relatively large vessel (e.g., in comparison to a human) has the potential to injure a swimmer. As another example, when a relatively small human-powered vessel (e.g., a kayak, a canoe, a row boat) is nearby, it may be considered rude or dangerous to travel at a speed above another threshold speed (e.g., an idle velocity for the vessel, about 0.5-1 m/s greater than a velocity when a swimmer or human-powered vessel is nearby, etc.), as a relatively large vessel (e.g., in comparison to the human-powered vessel) has the potential to upset, capsize, or swamp the human-powered vessel if travelling fast enough (and/or performing certain maneuvers) to create a relatively large wake (e.g., with respect to the size of the human-powered vessel). As yet another example, when a similarly-sized vessel (e.g., another vessel of roughly equal size, whether powered or unpowered) is nearby, it may be considered rude or dangerous to travel at a speed above yet another threshold speed (e.g., a maximum velocity at which significant wake is not generated, 3-4 m/s for certain vessels, etc.)), as travelling past a similarly-sized vessel at speed can physically disturb occupants of the vessel (e.g., via a wake) and/or can cause distress (e.g., at what may appear to be a near-collision, as an occupant or user of the other vessel may not be aware that a path of the vessel has been planned that avoids colliding with the other vessel). In some embodiments, a velocity limit below an idle velocity can be set, and a propulsion controller (e.g., CCM 24) can intermittently provide thrust to stay within the velocity limit (e.g., by shifting between neutral and forward idle and/or reverse idle intermittently).

In some embodiments, process 500 can determine whether there are any objects of particular types (e.g., objects that are instances of a particular class) within the predetermined area around the vessel based on the proximity information, and can determine a velocity limit to set based on velocity limits associated with each type of object. For example, certain classes of objects (e.g., swimmers, human-powered vessels, etc.) can be associated with a relatively low maximum velocity, while other classes of objects (e.g., non-mobile inanimate objects, such as navigation aids, empty docks, etc.; mobile inanimate objects that are not associated with humans, such as logs, floating vegetation, floating trash, etc.) can be associated with no maximum velocity.

Additionally or alternatively, in some embodiments, process 500 can determine a metric indicative of a density of objects within the predetermined area around the vessel based on the proximity information, and can determine a velocity limit to set based on the metric indicative of the density of objects within the predetermined area. For example, the metric indicative of density can be based on the total number of objects within the predetermined area (e.g., based on information indicative of a number of instances of various types of objects). As another example, the metric indicative of density can be based on the portion of the predetermined area that is occupied. In a more particular example, the metric indicative of density can be based on cells of the occupancy grid that fall within the predetermined area, and a number of those cells that are likely occupied. In such an example, process 500 can use a ratio of occupied cells to total cells of the occupancy grid as the metric indicative of density. In some embodiments, certain classes of features and/or objects, such as land, can be excluded from a calculation of a metric indicative of density.

In some embodiments, process 500 can determine and/or modify a metric indicative of a density of objects within the predetermined area around the vessel based on a distribution of objects. For example, if process 500 determines that there are objects to both a port and starboard side, process 500 can set a lower velocity limit than if process 500 determines that there are objects on only one side.

In some embodiments, process 500 can determine a velocity limit to set based on velocity limits associated with different ranges of the metric indicative of density. For example, process 500 can set different velocity limits based on the number of objects within a predetermined area around the vessel. In a more particular example, if there are no objects present in a predetermined area around the vessel, process 500 can determine that no additional velocity limit is to be set (e.g., "NO" at 508, as described below). As another more particular example, if there are is one object present in the predetermined area around the vessel, process 500 can set a first velocity limit. As yet another more particular example, if there are is more than one object present in the predetermined area around the vessel, process 500 can set a second velocity limit that is lower than the first velocity limit.

As another example, process 500 can set different velocity limits based on an occupancy ratio of a predetermined area around the vessel. In a more particular example, if the occupancy ratio is less than (or less than or equal to) a first threshold (e.g., 5% occupancy), process 500 can determine that no additional velocity limit is to be set (e.g., "NO" at 508, as described below). As another more particular example, if the occupancy ratio is greater than or equal to (or greater than) the first threshold (e.g., 5% occupancy) and less than (or less than or equal to) a second threshold (e.g., 10% occupancy), process 500 can set a first velocity limit. As yet another more particular example, if the occupancy ratio is greater than or equal to (or greater than) the second threshold (e.g., 10% occupancy), process 500 can set a second velocity limit that is lower than the first velocity limit.

As yet another example, process 500 can set different velocity limits based on a distribution of objects in a predetermined area around the vessel. In a more particular example, if there are fewer than a threshold number of objects on a lower density side of the vessel within the predetermined area (e.g., zero objects on the low density side, no more than one object on the lower density side, etc.), process 500 can determine that the vessel is travelling past any objects within the predetermined area (which may or may not be associated with a velocity limit, for example, based on the type of object within the predetermined area, based on the distance to the nearest object, etc.). As another more particular example, process 500 can determine that the vessel is travelling through objects within the predetermined area if there are at least a threshold number of objects on a lower density side (e.g., at least one object, more than one object, etc.). In such an example, process 500 can set a lower velocity limit when traveling through objects based on the distribution of objects within the predetermined area.

In some embodiments, process 500 can reduce a velocity limit proportionally to the metric indicative of density. For example, process 500 can use a maximum metric value (e.g., a value at which a lowest velocity limit is imposed, a value at which process 500 causes the vessel to stop and/or causes the vessel to inhibit autonomous operation) to set the velocity limit. In a more particular example, a maximum velocity can be reduced based on a ratio of the current metric indicative of density to the maximum metric (e.g., a current velocity limit based on the type of maneuver, location, types of objects in the predetermined area, etc., can be multiplied by one minus the ratio of the current metric indicative of density to the maximum metric).

In some embodiments, process 500 can weight different obstacles differently to determine a metric indicative of density. For example, certain classes of objects can be weighted more than other classes of objects. In a more particular example, human objects (e.g., swimmers, persons in human-powered vessels, etc.) can be weighted higher (e.g., with a weight greater than 1), and/or non-mobile objects (e.g., rocks, docks, navigation aids, etc.) can be weighted lower (e.g., with a weight less than 1).

As another example, objects in different locations can be weighted differently. In a more particular example, objects ahead of the vessel (e.g., falling within a front half of the predetermined area, falling within a quadrant in front of the vessel, etc.) can be weighted higher (e.g., with a weight greater than 1), and/or objects behind the vessel (e.g., falling within a back half of the predetermined area, falling within a quadrant in back of the vessel, etc.) can be weighted lower (e.g., with a weight less than 1).

In some embodiments, such weighting can be used for different types of metrics indicative of density. For example, weighting can be used in calculating a number of objects, such that some objects of certain types can be counted as more than one object. As another example, weighting can be used in calculating a density metric based on an occupancy ratio, such that cells that are occupied with certain types of objects can be counted as more than one occupied cell.

In some embodiments, process 500 can determine whether there any objects within a threshold distance of the vessel associated with process 500 (e.g., in any direction, and not necessarily in a path of the vessel), and can set a velocity limit based on a distance to a nearest object. For example, if an object is within 15 m (or a closer distance, such as 10 m, 7.5 m, 5 m, etc., which may depend on the size of the vessel), process 500 can set a velocity limit based on the presence of at least one object within 15 m. As another example, if an object is closer than the threshold distance (e.g., closer than 15 m, 10 m, 7.5 m, 5 m, etc.), process 500 can reduce the velocity limit further (e.g., until reaching a limit of zero m/s at a buffer distance from the vessel). In a more particular example, process 500 can set a relatively low velocity limit (e.g., corresponding to idle velocity) In some embodiments, process 500 can use a different threshold distance along different directions. For example, process 500 can use a first distance threshold in a general direction of motion (e.g., for objects in a front half of the predetermined area), and a second (higher) distance threshold in other directions. Note that in some embodiments, process 500 can ignore certain classes of objects (e.g., non-mobile objects, and/or objects that are not associated with human users, such as trees, rocks, navigation aids, etc.).

In some embodiments, process 500 can determine whether there any objects that are moving in a direction of the vessel associated with process 500 and/or the planned path of the vessel, and can set a velocity limit based on the velocity of the object. For example, process 500 can set a lower velocity limit in response to determining that an object is moving in a direction of the vessel and/or the planned path.

In some embodiments, process 500 can set multiple velocity limits, and can impose a lowest limit of the set of velocity limits to control propulsion (e.g., as described below in connection with 512). For example, process 500 can set a velocity limit based on a type of object located in the predetermined area, can set a another velocity limit based on the density of objects within the predetermined area, and can set yet another velocity limit based on a distance to a closest object.

In addition to, or in lieu of, a velocity limit, in some embodiments, process 500 can restrict types of maneuvers that can be performed (e.g., during autonomous navigation, during semi-autonomous navigation, etc.) based on set one or more objects within the predetermined area around the vessel. In some embodiments, process 500 can inhibit certain maneuvers based on the objects within the predetermined area around the vessel (e.g., based on a number of objects, a density of objects, and/or a type of object in a vicinity of the vessel). For example, based on a number of objects, a density of objects, and/or a type of object in a vicinity of the vessel, process 500 can set a limit that inhibits maneuvers that are more likely to cause a substantial wake at relatively low speeds (e.g., a yaw maneuver, a sway maneuver, etc.). In some embodiments, process 500 can omit prohibiting such maneuvers for vessels that are configured to use lateral thrusters (e.g., rather than utilizing only a stern motor(s) to perform such a maneuver).

In some embodiments, process 500 can determine whether a target location is within a predetermined distance of a current location of the vessel, and can determine a velocity limit to set based on the proximity to the target location. For example, if the current location is within a predetermined distance of the target location (e.g., 25 meters, $d_{radius}$, etc.), process 500 can determine a lower velocity limit (e.g., 1 m/s, or any other suitable velocity limit below a velocity limit imposed during navigation farther from the target location).

If process 500 determines that a reduced velocity limit is not to be set based on one or more objects within the predetermined area around the vessel ("NO" at 508), process 500 can return to 502.

Otherwise, if process 500 determines that a reduced velocity limit is to be set based on one or more objects within the predetermined area around the vessel ("YES" at 508), process 500 can move to 510.

At 510, process 500 can set a reduced velocity limit based on a determination at 506, using any suitable technique or combination of techniques. For example, process 500 can provide a velocity limit to be set to memory (e.g., a memory location associated with sensor processor 70, a memory location associated with CCM 24, a memory location associated with PCM 26*a*, and/or 26*b*, etc.). As another example, process 500 can provide a velocity limit to be set as a signal (e.g., a signal provided to sensor processor 70, a signal provided to CCM 24, a signal provided to PCM 26*a*, and/or 26*b*, etc.). In such an example, the signal can explicitly include the velocity limit (e.g., as an explicit velocity value, such as 1.0, encoded directly in the signal), or can be encoded in the signal (e.g., a string of bits and/or bytes can be used to convey a current velocity limit(s), and different codes can be associated with different limits using an encoding scheme).

At 512, process 500 can control propulsion of the vessel associated with process 500 to enforce a reduced velocity limit set at 510. For example, process 500 can control signals provided to propulsion devices 12*a*, 12*b*, PCMs 26*a*, 26*b*, etc., to limit a maximum velocity of the vessel.

Figure 6:
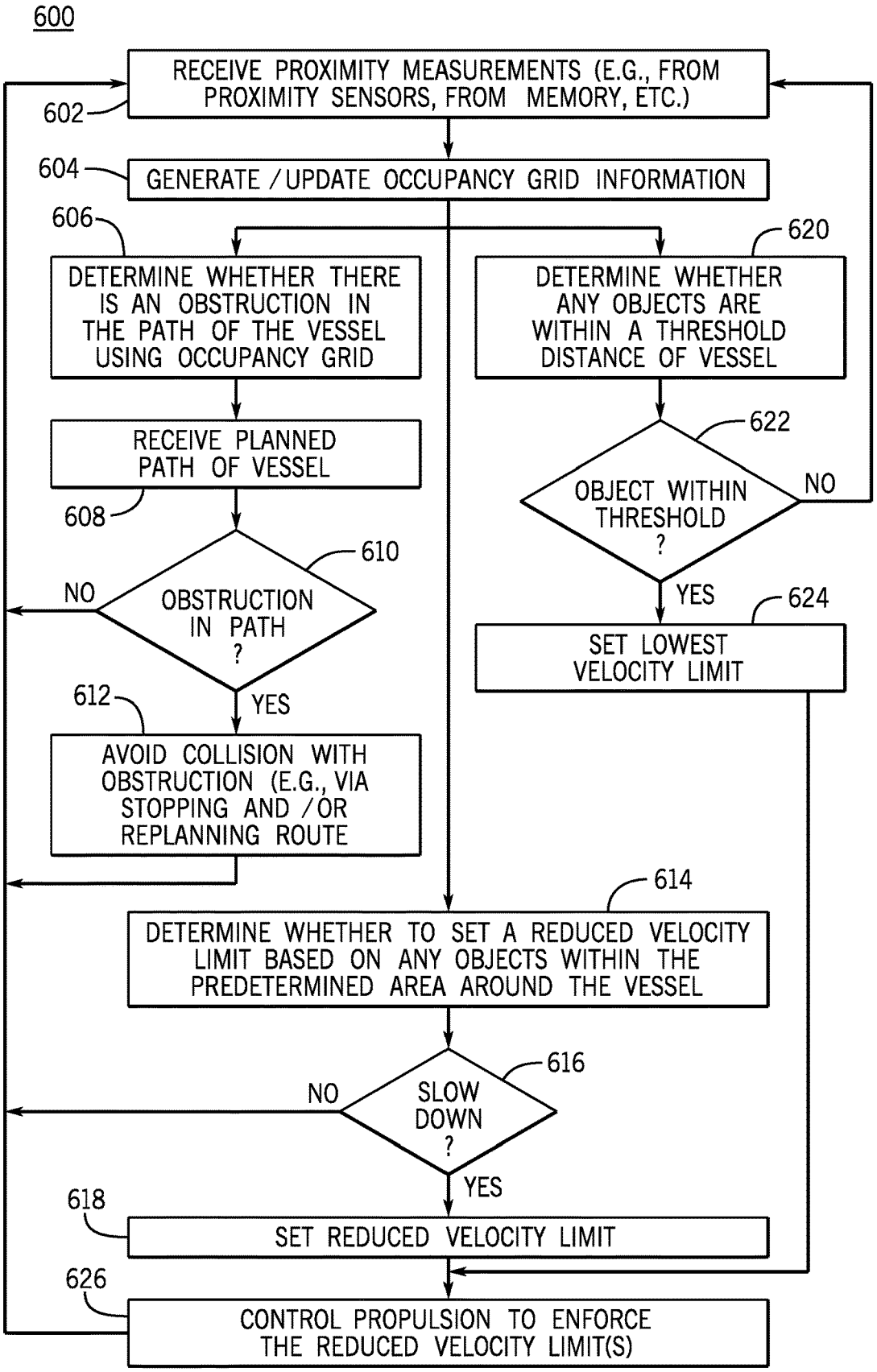
FIG. 6 shows another example of a process for setting a velocity limit based on objects within a local consideration zone around a marine vessel in accordance with some embodiments of the disclosed subject matter.

FIG. 6 shows another example of a process 600 for setting a velocity limit based on objects within a local consideration zone around a marine vessel in accordance with some embodiments of the disclosed subject matter.

At 602, process 600 can receive proximity measurements that can be used to determine the position of objects in an area around a vessel (e.g., vessel 10) associated with process 600. In some embodiments, the proximity measurements can include any suitable information (e.g., as described above in connection with process 500 of FIG. 5), and can be received from any suitable source (e.g., as described above in connection with process 500 of FIG. 5).

At 604, process 600 can generate an occupancy grid based on the proximity measurements using any suitable technique or combination of techniques.

At 606, process 600 can receive information indicative of a planned path of the vessel associated with process 600. In some embodiments, the planned path can be in any suitable format and/or from any suitable source. For example, the planned path can be received as a line with respect to the occupancy grid received at 604.

At 608, process 600 can determine whether there's an obstruction in the planned path using the occupancy grid and the planned path of the vessel. For example, process 600 can periodically (e.g., at regular and/or irregular intervals) project a model of the vessel forward along the planned path a predetermined distance(s) to determine whether the vessel is likely to collide with any obstacles that may have obstructed the planned path (e.g., since the path was planned).

If process 600 determines that there is not an obstruction in the path of the vessel ("NO" at 610), process 600 can return to 602, and can continue to receive proximity measurements and, at 604, can continue to update the occupancy grid information.

Otherwise, if process 600 determines that there is an obstruction in the path of the vessel ("YES" at 610), process 600 can move to 612.

At 612, process 600 can control propulsion of the vessel to avoid a collision with the obstruction (e.g., by slowing and/or stopping the vessel) and/or by initiating replanning of the path to avoid the obstacle.

At 614, process 600 can determine whether to set a reduced velocity limit based on a presence of any objects within a predetermined area around the vessel (e.g., as described above in connection with 504-506 of FIG. 5).

If process 600 determines that a reduced velocity limit is not to be set based on one or more objects within the predetermined area around the vessel ("NO" at 616), process 600 can return to 602.

Otherwise, if process 600 determines that a reduced velocity limit is to be set based on one or more objects within the predetermined area around the vessel ("YES" at 616), process 600 can move to 618.

At 618, process 600 can set a reduced velocity limit based on a determination at 616, using any suitable technique or combination of techniques (e.g., techniques described above in connection with 510).

At 620, process 600 can determine whether any objects are within a threshold distance of the vessel associated with process 600 (e.g., in any direction, and not necessarily in a path of the vessel), and can set a velocity limit based on a distance to a nearest object (e.g., as described above in connection with 508 of FIG. 5). In some embodiments, process 600 can use a different threshold distance along different directions (e.g., as described above in connection with 508 of FIG. 5).

If process 600 determines that an object is not within the threshold distance ("NO" at 622), process 600 can return to 602.

Otherwise, if process 600 determines that an object is within the threshold distance ("YES" at 622), process 600 can move to 624.

At 624, process 600 can set the reduced velocity limit based on the presence of an object within the threshold distance around the vessel, which may be a lowest velocity limit. In some embodiments, process 600 can set the reduced velocity limit using any suitable technique or combination of techniques (e.g., techniques described above in connection with 510).

At 626, process 600 can control propulsion of the vessel associated with process 600 to enforce a reduced velocity limit set at 624 and/or 626. For example, process 600 can control signals provided to propulsion devices 12*a*, 12*b*, PCMs 26*a*, 26*b*, etc., to limit a maximum velocity of the vessel.

Figure 7:
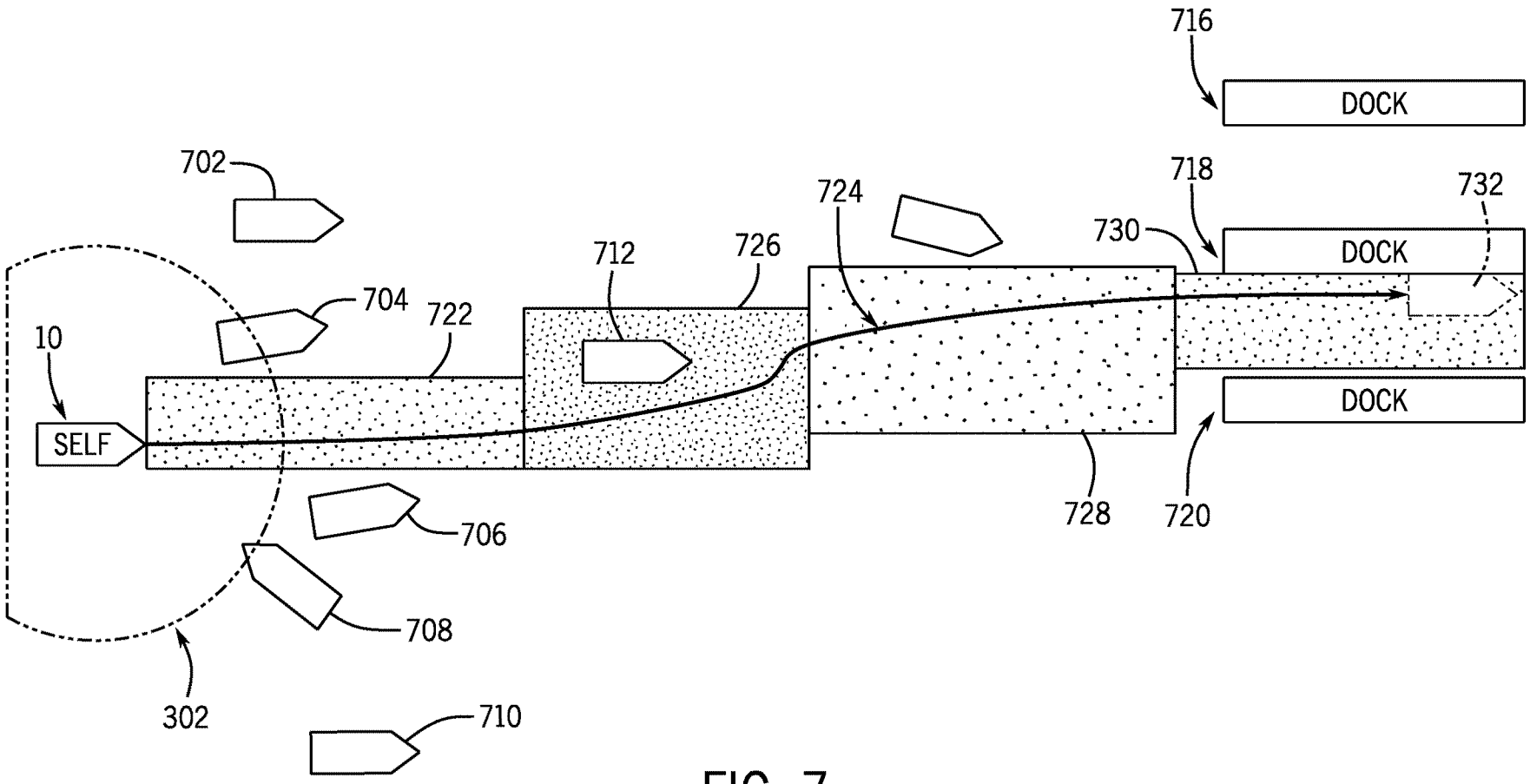
FIG. 7 shows an example of a marine vessel executing a process for setting a velocity limit based on objects within a local consideration zone in accordance with some embodiments of the disclosed subject matter.

FIG. 7 shows an example of a marine vessel executing a process for setting a velocity limit based on objects within a local consideration zone in accordance with some embodiments of the disclosed subject matter.

As shown in FIG. 7, a velocity of vessel 10 can be limited based on the presence of objects (e.g., boats 702-714, docks 716-720). For example, along a portion 722 of a planned path 724 in which a density of objects is relatively high, a lower velocity limit can be imposed (e.g., based on process 500 and/or process 600 described above in connection with FIGS. 5 and 6, respectively).

As another example, along a portion 726 of planned path 724 in which vessel 10 passes close to an object (e.g., boat 712), an even lower velocity limit can be imposed (e.g., based on process 500 and/or process 600 described above in connection with FIGS. 5 and 6, respectively).

As still another example, along a portion 728 of planned path 724 in which a density of objects is low, a nominal velocity limit can be imposed (e.g., based on a velocity limit associated with an autonomous navigation task being performed, such as 2 m/s, a no-wake speed, an idle speed, etc.).

As yet another example, along a portion 730 of planned path 724 in which a density of objects is higher and/or which is near (e.g., within a threshold distance of) a target location 732, a lower velocity limit can be imposed (e.g., based on process 500 and/or process 600 described above in connection with FIGS. 5 and 6, respectively).

Figure 8:
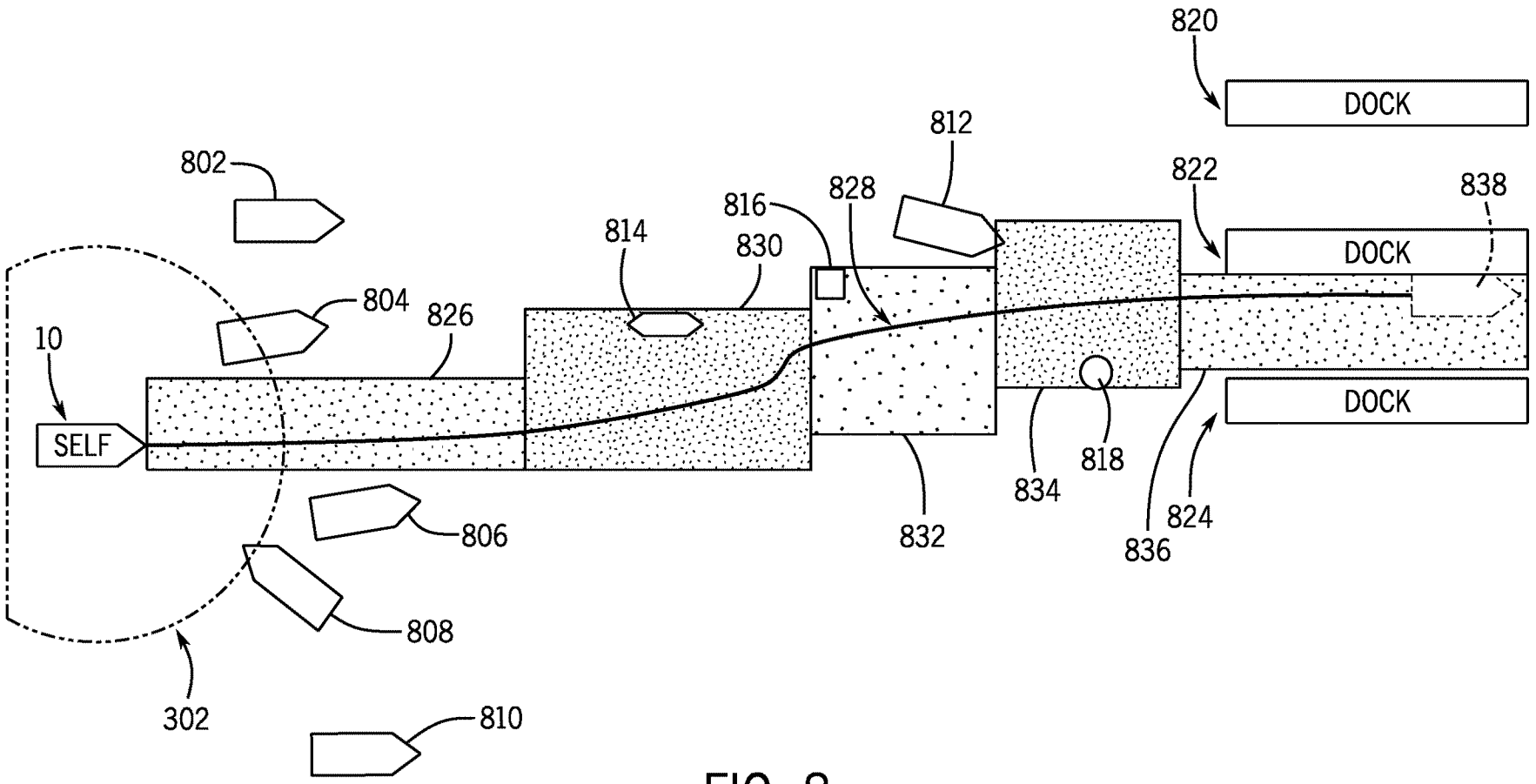
FIG. 8 shows another example of a marine vessel executing a process for setting a velocity limit based on objects within a local consideration zone in accordance with some embodiments of the disclosed subject matter.

FIG. 8 shows another example of a marine vessel executing a process for setting a velocity limit based on objects within a local consideration zone in accordance with some embodiments of the disclosed subject matter.

As shown in FIG. 8, a velocity of vessel 10 can be limited based on the presence of objects (e.g., boats 802-812, kayak 814, navigation aid 816, swimmer 818, and docks 820-824). For example, along a portion 826 of a planned path 828 in which a density of objects (e.g., classified in a boat class) is relatively high, a lower velocity limit can be imposed (e.g., based on process 500 and/or process 600 described above in connection with FIGS. 5 and 6, respectively).

As another example, along a portion 830 of planned path 828 in which a sensitive obstacle (e.g., a human-powered vessel, such as kayak 814) is relatively close to vessel 10, an even lower velocity limit can be imposed (e.g., based on process 500 and/or process 600 described above in connection with FIGS. 5 and 6, respectively).

As still another example, along a portion 832 of planned path 828 in which a non-mobile and non-sensitive object is present (e.g., navigation aid 816), a nominal velocity limit can be imposed (e.g., based on a velocity limit associated with an autonomous navigation task being performed, such as 2 m/s, a no-wake speed, an idle speed, etc.).

As yet another example, along a portion 834 of planned path 828 in which a sensitive obstacle (e.g., a person at water level, such as swimmer 818) is relatively close to vessel 10, an even lower velocity limit can be imposed (e.g., based on process 500 and/or process 600 described above in connection with FIGS. 5 and 6, respectively).

As a further example, along a portion 834 of planned path 828 in which a density of objects is higher (e.g., based on presence of docks 822 and 824) and/or which is near (e.g., within a threshold distance of) a target location 838, a lower velocity limit can be imposed (e.g., based on process 500 and/or process 600 described above in connection with FIGS. 5 and 6, respectively).

Further Examples Having a Variety of Features

Implementation examples are described in the following numbered clauses:

1. A method for controlling propulsion of a marine vessel, the method comprising: receiving proximity information based on proximity measurements generated by a plurality of proximity sensors, wherein the plurality of proximity sensors are configured to generate proximity measurements indicative of a proximity of an object with respect to the marine vessel; analyzing the proximity information within a predetermined area around the marine vessel; determining that one or more objects are located in the predetermined area around the marine vessel, wherein the one or more objects are not in a planned path of the marine vessel; setting a velocity limit along the planned path of the marine vessel based at least in part on the presence of the one or more objects within the predetermined area; and controlling at least one propulsion device configured to propel the marine vessel such that a velocity of the marine vessel along the planned path does not exceed the velocity limit.

2. The method of clause 1, wherein the predetermined area around the marine vessel has a circular shape that extends in a radius $d_{radius}$.

3. The method of clause 2, wherein $d_{radius}$ is not greater than 25 meters.

4. The method of any one of clauses clause 1 to 3, wherein the predetermined area around the marine vessel extends in a forward direction along the planned path a distance $d_{ahead}$, and extends in a backward direction along the planned path a distance $d_{behind}$.

5. The method of clause 4, wherein $d_{ahead} > d_{behind}$.

6. The method of any one of clauses 1 to 5, wherein the proximity information comprises an occupancy grid comprising a plurality of cells, wherein a value associated with each cell is indicative of a probability that the cell is occupied by an obstruction.

7. The method of clause 6, wherein the occupancy grid is associated with a plurality of layers, each of the plurality of layers indicative of a probability that the cell is occupied by an obstruction that is an instance of a respective class of a plurality of classes.

8. The method of clause 7, further comprising: setting the velocity limit based on a probability that a cell of the occupancy grid within the predetermined area around the marine vessel is occupied by an obstruction that is an instance of a class within a set of classes of the plurality of classes.

9. The method of clause 8, wherein the set of classes includes: a class encompassing swimmers; and a class encompassing human-powered vessels.

10. The method of clause 9, wherein the set of classes excludes all classes that encompass non-mobile inanimate objects.

11. The method of clause 8, further comprising: receiving second proximity information based on second proximity measurements generated by the plurality of proximity sensors during a second period of time, wherein the proximity information is based on proximity measurements generated by the plurality of proximity sensors during a first period of time; analyzing the second proximity information within the predetermined area around the marine vessel; determining that a second set of one or more objects are located in the predetermined area around the marine vessel, wherein the second set of one or more objects are not in a planned path of the marine vessel; determining that none of the objects in the second set of objects are an instance of a class within the set of classes of the plurality of classes; and setting a second velocity limit along the planned path of the marine vessel based at least in part on the presence of the second set of one or more objects within the predetermined area, wherein the second velocity limit is higher than the velocity limit.

12. The method of any one of clauses 1 to 11, further comprising: receiving information indicative of a planned path of the marine vessel periodically.

13. The method of clause 12, further comprising: analyzing the proximity information within the predetermined area around the marine vessel more often than the information indicative of the planned path of the marine vessel is received.

14. The method of any one of clauses 1 to 13, further comprising: determining that a particular object of the one or more objects is located within a threshold distance of the marine vessel; and in response to determining that the particular object of the one or more objects is located within the threshold distance of the marine vessel, setting a third velocity limit, wherein the third velocity limit is lower than the velocity limit.

15. The method of any one of clauses 1 to 14, further comprising: receiving information indicative of a number of objects within the predetermined area; and setting the velocity limit based at least in part on the number of objects within the predetermined area.

16. The method of any one of clauses 1 to 15, further comprising: determining a ratio of the predetermined area around the vessel that is occupied by obstructions based on the proximity information; and setting the velocity limit based at least in part on the ratio.

17. The method of any one of clauses 1 to 16, further comprising: determining that an object of a particular class is located in the predetermined area around the marine vessel; and in response to determining that an object of a particular class is located in the predetermined area around the marine vessel, inhibiting use of at least one navigation maneuver.

18. The method of clause 17, wherein the at least one navigation maneuver includes a sway maneuver that causes movement in a direction perpendicular to a center line of the marine vessel.

19. The method of any one of clauses 1 to 18, wherein the velocity limit is no greater than 1 meter per second.

20. The method of any one of clauses 1 to 19, wherein the plurality of proximity sensors includes at least one stereoscopic camera.

21. A propulsion control system on a marine vessel, the propulsion control system comprising: at least one processor that is configured to: perform a method of any of clauses 1 to 20.

22. A non-transitory computer-readable medium storing computer-executable code, comprising code for causing a computer to cause a processor to: perform a method of any of clauses 1 to 20.

In some embodiments, any suitable computer readable media can be used for storing instructions for performing functions and/or processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as RAM, Flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, or any suitable media that is fleeting and devoid of any semblance of permanence during transmission, and/or any suitable intangible media.

It should be noted that, as used herein, the term mechanism can encompass hardware, software, firmware, or any suitable combination thereof.

It should be understood that above-described steps of the processes of FIG. 5 can be executed or performed in any suitable order or sequence not limited to the order and sequence shown and described in the figures. Also, some of the above steps of the processes of FIG. 5 can be executed or performed substantially simultaneously where appropriate or in parallel to reduce latency and processing times.

This written description uses examples to disclose the invention(s), including the best mode, and also to enable any person skilled in the art to make and use the invention(s). Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention(s) is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion control system on a marine vessel, the propulsion control system comprising:

at least one propulsion device configured to propel the marine vessel;

a plurality of proximity sensors configured to generate proximity measurements indicative of a proximity of an object with respect to the marine vessel;

one or more hardware processors configured to:

receive proximity information based on proximity measurements generated by the plurality of proximity sensors;

analyze the proximity information within a predetermined area around the marine vessel;

determine that one or more objects are located in the predetermined area around the marine vessel, wherein the one or more objects are not in a planned path of the marine vessel;

set a velocity limit along the planned path of the marine vessel based at least in part on the presence of the one or more objects within the predetermined area; and control the at least one propulsion device such that a velocity of the marine vessel along the planned path does not exceed the velocity limit.

2. The system of claim 1, wherein the predetermined area around the marine vessel has a circular shape that extends in a radius $d_{radius}$ that is not greater than 25 meters.

3. The system of claim 1, wherein the predetermined area around the marine vessel extends in a forward direction along the planned path a distance $d_{ahead}$, and extends in a backward direction along the planned path a distance $d_{behind}$.

4. The system of claim 3, wherein $d_{ahead}>d_{behind}$.

5. The system of claim 1, wherein the proximity information comprises an occupancy grid comprising a plurality of cells, wherein a value associated with each cell is indicative of a probability that the cell is occupied by an obstruction.

6. The system of claim 5, wherein the occupancy grid is associated with a plurality of layers, each of the plurality of layers indicative of a probability that the cell is occupied by an obstruction that is an instance of a respective class of a plurality of classes.

7. The system of claim 6, wherein the one or more hardware processors are further configured to:

set the velocity limit based on a probability that a cell of the occupancy grid within the predetermined area around the marine vessel is occupied by an obstruction that is an instance of a class within a set of classes of the plurality of classes.

8. The system of claim 7, wherein the set of classes includes:

a class encompassing swimmers; and a class encompassing human powered vessels; and excludes all classes that encompass non-mobile inanimate objects.

9. The system of claim 7, wherein the one or more hardware processors are further configured to:

receive second proximity information based on second proximity measurements generated by the plurality of proximity sensors during a second period of time, wherein the proximity information is based on proximity measurements generated by the plurality of proximity sensors during a first period of time;

analyze the second proximity information within the predetermined area around the marine vessel;

determine that a second set of one or more objects are located in the predetermined area around the marine vessel, wherein the second set of one or more objects are not in a planned path of the marine vessel;

determine that none of the objects in the second set of objects are an instance of a class within the set of classes of the plurality of classes; and set a second velocity limit along the planned path of the marine vessel based at least in part on the presence of the second set of one or more objects within the predetermined area, wherein the second velocity limit is higher than the velocity limit.

10. The system of claim 1, wherein the one or more hardware processors are further configured to:

determine that a particular object of the one or more objects is located within a threshold distance of the marine vessel; and in response to determining that the particular object of the one or more objects is located within the threshold distance of the marine vessel, set a second velocity limit, wherein the second velocity limit is lower than the velocity limit.

11. The system of claim 1, wherein the velocity limit is no greater than 1 meter per second.

12. The system of claim 1, wherein the plurality of proximity sensors includes at least one stereoscopic camera.

13. A method for controlling propulsion of a marine vessel, the method comprising:

receiving proximity information based on proximity measurements generated by a plurality of proximity sensors, wherein the plurality of proximity sensors are configured to generate proximity measurements indicative of a proximity of an object with respect to the marine vessel;

analyzing the proximity information within a predetermined area around the marine vessel;

determining that one or more objects are located in the predetermined area around the marine vessel, wherein the one or more objects are not in a planned path of the marine vessel;

setting a velocity limit along the planned path of the marine vessel based at least in part on the presence of the one or more objects within the predetermined area; and controlling at least one propulsion device configured to propel the marine vessel such that a velocity of the marine vessel along the planned path does not exceed the velocity limit.

14. The method of claim 13, wherein the predetermined area around the marine vessel has a circular shape that extends in a radius $d_{radius}$ that is not greater than 25 meters.

15. The method of claim 14, wherein $d_{radius}$ is not greater less than 10 meters.

16. The method of claim 13, wherein the predetermined area around the marine vessel extends in a forward direction along the planned path a distance $d_{ahead}$, and extends in a backward direction along the planned path a distance $d_{behind}$.

17. The method of claim 16, wherein $d_{ahead}>d_{behind}$.

18. The method of claim 13, wherein the proximity information comprises an occupancy grid comprising a plurality of cells, wherein a value associated with each cell is indicative of a probability that the cell is occupied by an obstruction.

19. The method of claim 18, wherein the occupancy grid is associated with a plurality of layers, each of the plurality of layers indicative of a probability that the cell is occupied by an obstruction that is an instance of a respective class of a plurality of classes.

20. The method of claim 19, further comprising:

setting the velocity limit based on a probability that a cell of the occupancy grid within the predetermined area around the marine vessel is occupied by an obstruction that is an instance of a class within a set of classes of the plurality of classes.

21. The method of claim 13, further comprising:

determining that a particular object of the one or more objects is located within a threshold distance of the marine vessel; and in response to determining that the particular object of the one or more objects is located within the threshold distance of the marine vessel, setting a second velocity limit, wherein the second velocity limit is lower than the velocity limit.

22. The method of claim 13, wherein the velocity limit is no greater than 1 meter per second.

23. The system of claim 1, wherein the planned path is at least a portion of a path for autonomous navigation between a current location of the marine vessel and a target location of the marine vessel that avoids colliding with any objects.

24. The system of claim 1, wherein the one or more hardware processors are further configured to:

calculate a long-term path for the marine vessel between a current location of the marine vessel and a target location for the marine vessel using a first model of the marine vessel, wherein the long-term path avoids collisions between the first model of the marine vessel and objects in a marine environment of the marine vessel; and calculate a shorter-term path for the marine vessel corresponding to a predetermined portion of the long-term path between the current location of the marine vessel and a location along the long-term path using a second model of the marine vessel that is more complex than the first model of the vessel, wherein the shorter-term path avoids collisions between the second model of the marine vessel and objects in the marine environment.

25. The system of claim 1, wherein the one or more hardware processors are further configured to:

receive an image of an environment of the marine vessel;

generate classification information for an imaged object in the environment using the image and a trained machine learning model, wherein the classification information includes information indicative a most likely class of the imaged object of a set of classes;

update a cell of an occupancy grid based on the classification information, wherein the cell is within the predetermined area around the marine vessel; and set the velocity limit based on the classification information associated with the cell.

* * * * *